US007937024B2

(12) United States Patent
Muto et al.

(10) Patent No.: US 7,937,024 B2
(45) Date of Patent: May 3, 2011

(54) IMAGE FORMING APPARATUS UTILIZING TECHNOLOGY OF PERIODICALLY VARYING ROTATIONAL SPEED OF MOTOR

(75) Inventors: Kenji Muto, Fujisawa (JP); Norio Matsui, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 755 days.

(21) Appl. No.: 11/772,481

(22) Filed: Jul. 2, 2007

(65) Prior Publication Data

US 2008/0124128 A1 May 29, 2008

(30) Foreign Application Priority Data

Jul. 3, 2006 (JP) ..... 2006-183948
Jun. 28, 2007 (JP) ..... 2007-170666

(51) Int. Cl.
*G03G 15/00* (2006.01)

(52) U.S. Cl. ..... 399/167; 399/66

(58) Field of Classification Search ..... 399/167, 399/66

See application file for complete search history.

(56) References Cited

U.S. PATENT DOCUMENTS 5,329,341 A 7/1994 Nowak et al.
6,141,515 A * 10/2000 Takeda et al. ..... 399/167
6,330,403 B1 12/2001 Tsujita ..... 399/44
7,095,972 B2 8/2006 Iwai ..... 399/299
2004/0056178 A1* 3/2004 Takeyama et al. ..... 250/208.1
2007/0025768 A1* 2/2007 Komatsu et al. ..... 399/167
2007/0188794 A1 8/2007 Matsui et al. ..... 358/1.15

FOREIGN PATENT DOCUMENTS

| | | |
|---|---|---|
| JP | 4-204859 | 7/1992 |
| JP | 9-191674 | 7/1997 |
| JP | 9-197846 | 7/1997 |
| JP | 11-316532 | 11/1999 |
| JP | 2000316286 | * 11/2000 |
| JP | 2000-354386 | 12/2000 |
| JP | 2001-142316 | 5/2001 |
| JP | 2003-173094 | 6/2003 |
| JP | 2003-316090 | 11/2003 |
| JP | 2004-198843 | 7/2004 |
| JP | 2005-192276 | 7/2005 |

* cited by examiner

*Primary Examiner* — David M Gray
*Assistant Examiner* — Roy Yi
(74) *Attorney, Agent, or Firm* — Fitzpatrick, Cella, Harper & Scinto

(57) ABSTRACT

The image bearing member to improve transfer efficiency at an occasion of transferring a toner image from the image bearing member. A rotational speed of a motor rotating the image bearing member in a short period and thereby disorder in a toner image can be restrained to reach a low level. On the other hand, circumferential velocity between the image bearing member and paper can be provided large. Therefore improvement in transfer efficiency can be designed.

23 Claims, 19 Drawing Sheets

PSEUDO FREQUENCY MODULATION SIGNAL

PSEUDO FREQUENCY MODULATION SIGNAL

IMAGE FORMING APPARATUS UTILIZING TECHNOLOGY OF PERIODICALLY VARYING ROTATIONAL SPEED OF MOTOR

BACKGROUND OF THE INVENTION

1. Field of the Invention

The present invention relates to an image forming apparatus periodically varying a difference in moving speed between an image bearing member and a moving member in a transfer nip for transferring a toner image onto the image bearing member.

2. Description of the Related Art

In an image forming apparatus in utilization of an electrophotographic system, an electrostatic transfer system is generally used as a transfer unit. That is, with a transfer corotron, a transfer bias roller and the like, transfer medium (a member to become an object where an image is transferred) is provided with charge in polarity opposite from the polarity of toner to, thereby, move a toner image developed onto an image bearing member onto transfer medium with an electrostatic force. However, in such an image forming apparatus, only the power of electric field is occasionally low in transfer efficiency of toner on the image bearing member onto a transfer medium. In addition, defects in transfer such as transfer missing and the like occasionally take place. Therefore, further improvement in transfer efficiency is called for.

Japanese Patent Application Laid-Open No. H09-197846 proposes prevention of transfer defects by varying speed of one of a transfer bias roller and a middle transferring belt. Thereby, by providing toner with oscillation to one of the sheet conveyance direction and the middle transferring member conveyance direction at the occasion of transfer, decrease in adhesion of toner to a photosensitive drum is intended. In the invention described in Japanese Patent Application Laid-Open No. H09-197846, one of transfer bias roller and a drive roller of a middle transferring member is driven with a stepping motor to provide oscillation in utilization of speed fluctuation inevitably taking place in principle on a step basis at an occasion when the stepping motor is driven.

However, in the invention described in Japanese Patent Application Laid-Open No. H09-197846, a speed fluctuation in a transfer bias roller and a drive roller of a middle transferring member is originated from the step angle of a stepping motor and, therefore, it is impossible to provide a fluctuation with an angle smaller than the minimum step angle. Normally, the step angle of the stepping motor is set based on drive torque realized by a motor, the rotational speed at the time of use and the like and is inferior in degree of freedom in setting of the step angle of the stepping motor. That is, actually, it is difficult to design a stepping motor providing a desired speed oscillation. Moreover, in the invention described in Japanese Patent Application Laid-Open No. H09-197846, the speed oscillation is intrinsic to a stepping motor and cannot be changed. The speed difference cannot be reset appropriately in conformity with use status.

On the other hand, U.S. Pat. No. 5,329,341 has proposed a system including a photosensitive belt being an image bearing member provided with oscillation with an ultrasonic resonator from the rear side of a toner retaining surface to increase toner delamination on a photosensitive belt to promote transfer. The invention described in U.S. Pat. No. 5,329,341 is adapted to include an oscillation unit of an ultrasonic resonator brought into a state in contact to a photosensitive belt in a configuration provided with walls in its periphery so that the interior enclosed by the walls is decompressed to retain tight contact and oscillation from the oscillation unit is transferred to the photosensitive belt. Moreover, the resonator is adapted to be driven at an average frequency of the primary and the secondary resonance frequency in a portion of the photosensitive belt spanned and retained by the walls in an intention that a fluctuation of oscillation amplitude hardly takes place for a fluctuation such as an impact due to sheet feeding.

However, the invention described in U.S. Pat. No. 5,329,341 requires an oscillation source called resonator besides the drive source to move the photosensitive belt, complicating the apparatus.

The present invention is to utilize a motor being a drive source of an image bearing member and a moving member to provide an appropriate speed fluctuation.

SUMMARY OF THE INVENTION

An object of the present invention is to restrain a disorder in toner image to be transferred to become low and to improve transfer efficiency.

Another object of the present invention is to provide an image forming apparatus comprising a movable image bearing member bearing a toner image, a movable moving member forming a nip portion with the image bearing member, and a motor moving one of the image bearing member and the moving member, wherein a toner image is transferred in the nip portion from the image bearing member, and wherein, in addition to base voltage capable of rotating the motor at a constant speed, oscillatory voltage causing the rotational speed of the motor to vary periodically is inputted to the motor.

Still another object of the present invention is to provide an image forming apparatus comprising a movable image bearing member bearing a toner image, a movable moving member forming a nip portion with the image bearing member, a motor moving one of the image bearing member and the moving member and a driver inputting drive voltage to the motor, wherein a toner image is transferred in the nip portion from the image bearing member; and wherein the driver modulates frequency of base voltage capable of rotating the motor at a constant speed and causes the rotational speed of the motor to vary periodically.

Further objects of the present invention will become apparent with reference to the following description and accompanying drawings.

Further features of the present invention will become apparent from the following description of exemplary embodiments with reference to the attached drawings.

DESCRIPTION OF THE EMBODIMENTS

Appropriate embodiments of the present invention will be described in detail in an exemplifying manner with reference to the drawings. There, size, material and shape of components described in the following embodiments, relative arrangements thereof and the like should be appropriately altered according to the configuration of an apparatus to which the present invention is applied and various kinds of conditions. Accordingly, they are not intended to limit the scope of the present invention only thereto unless there is any specific description in particular.

Embodiment 1

Whole Configuration and Operation of Image Forming Apparatus

Figure 1:
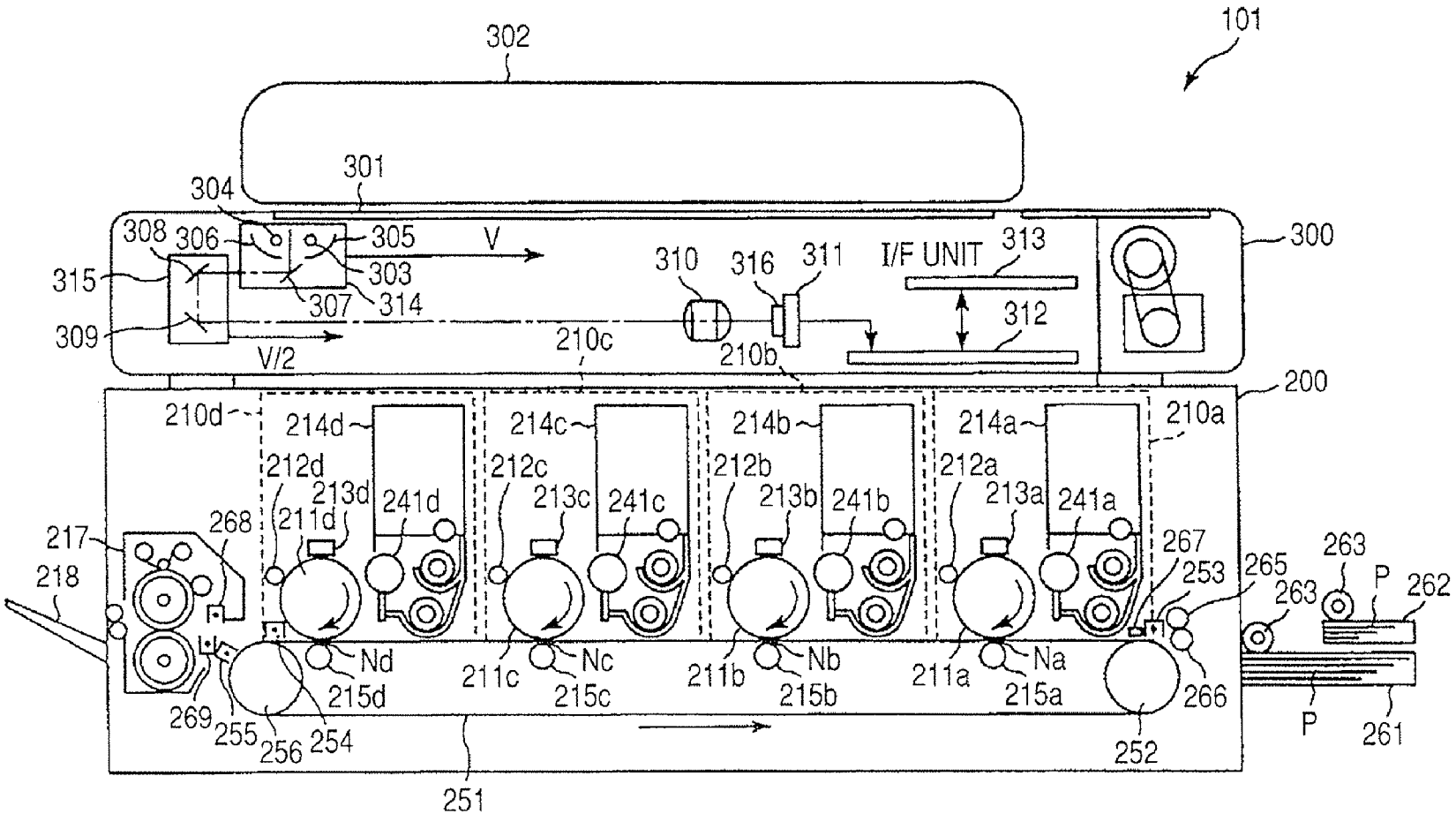
FIG. 1 is a schematic sectional configuration diagram of an image forming apparatus related to an Embodiment 1.

FIG. 1 is a schematic sectional configuration diagram of an embodiment of an image forming apparatus related to the present invention. An image forming apparatus 101 in the present embodiment is a color photocopier capable of forming a full color image onto recording material with an electrophotographic system. The image forming apparatus 101 of the present embodiment also functions as a printer that forms an image according to image information from external appliances such as a personal computer brought into connection to the apparatus body. In addition, the image forming apparatus 101 of the present embodiment is an image forming apparatus of a tandem type having adopted a direct transfer system.

The image forming apparatus 101 generally includes a printer unit 200 and a reader unit (manuscript reading unit) 300 in a rough classification.

At first, a configuration of a reader unit 300 will be described. In the reader unit 300, there are arranged a CCD 316, a substrate 311 where the CCD 316 is mounted, an image processing unit 312, a manuscript stand glass 301, a manuscript feeding apparatus 302 and light sources 303 and 304 of illuminating the manuscript. In addition, in the reader unit 300, there are arranged reflective umbrellas 305 and 306 focusing light onto a manuscript; mirrors 307, 308 and 309; a lens 310 focusing the reflective light from the manuscript on the projection light onto the CCD 316. In addition, in the reader unit 300, there are arranged a carriage 314 housing the light sources 300 and 304, the reflective umbrellas 305 and 306 and the mirror 307 and a carriage 315 housing the mirrors 308 and 309. n to another IPU and the like is arranged in the reader unit 300.

The carriage 314 moves at the speed V and the carriage 315 moves at the speed V/2 mechanically in the direction perpendicular to the electric scanning (main scanning) direction of the CCD 316. Thereby, the whole surface of the manuscript is scanned (vertically scanned).

The manuscript on the manuscript stand glass 301 reflects light from the light sources 303 and 304. The reflected light passes through a light-condensing lens 310 and is lead to the CCD 316 and is converted into an electric signal. The electric signal (analogue image signal) is input to the image processing unit 312 and is converted into a digital signal. The converted digital signal is processed, thereafter is transmitted to the printer unit 200 and is used to form an image.

Next, a configuration of the printer unit 200 will be described. The printer unit 200 is provided with the first to fourth printer units 210*a*, 210*b*, 210*c* and 210*d* for forming images respectively of magenta, cyan, yellow and black colors as a plurality of image forming units. Here, the present embodiment, the respective configurations of image forming units 210*a* to 210*d* are substantially the same besides difference in color of toner to be used. Therefore, in the case where no differentiation is required in particular, elements commonly provided in the respective image forming units 210*a* to 210*d* will be described in a collective manner by omitting the appending characters a, b, c and d which are given to the symbols in order to specify for which colors they are provided.

The image forming unit 210 is provided with photosensitive drum 211 being a cylindrical photosensitive member as an image bearing member in a rotatable manner in the arrowed direction in the drawing. The periphery of the photosensitive drum 211 is provided with a charging roller (primary charger) 212 as a primary charging unit, and an LED array 213 as an exposing unit (electrostatic image forming unit) and a developing device 214 as a developing unit. In addition, a movable endless belt as a moving member (recording material conveyance member), that is, a conveyance belt 251 is provided in opposition to the photosensitive drums 211*a* to 211*d* of the respective image forming units 210*a* to 210*d*. The conveyance belt 251 is spanned, as a supporting unit, around a drive roller 252 and a driven roller 256.

The charging roller 212 charges the surface of the rotating photosensitive drum 211 at a predetermined potential to make preparation for forming an electrostatic image. And the light from the LED array 213 forms an electrostatic image on the surface of the photosensitive drum 211. The developing device 214 carries out development by adhering toner in the developing agent to an electrostatic image on the photosensitive drum 211 to form a toner image. The developing device 214 is provided with a developing sleeve 241 as developing agent bearing member. The developing sleeve 241 conveys toner to a developing unit in opposition to the photosensitive drum 211 and thus a developing bias is applied. Thereby toner is adhered to the photosensitive drum 211.

The inner circumference side of the conveyance belt 251 is provided with transferring rollers (transferring chargers) 215*a* to 215*d* as transfer member in the positions opposing to the photosensitive drums 211*a* to 211*d* of the respective image forming units 210*a* to 210*d*. The transferring rollers 215*a* to 215*d* contact the inner circumference side of the conveyance belt 251 respectively to press the conveyance belt 251 toward the photosensitive drums 211*a* to 211*d*. Thereby, nip portions Na to Nd are formed respectively between the conveyance belt 251 and the photosensitive drums 211*a* to 211*d*. Thus, a transferring unit includes the conveyance belt 251 and the transferring rollers 215*a* to 215*d* for transferring toner onto a recording material P.

The transferring voltage having been output from the transferring bias output unit (not illustrated in the drawing) is applied to the transferring rollers 215. Thereby, the transferring roller 215 discharges the conveyance belt 251 from the rear surface to transfer a toner image on the photosensitive drum 211 onto a recording material P such as a recording sheet and the like on the conveyance belt 251.

Here, the present embodiment is not provided with a cleaner of cleaning the residual toner (transferring residual toner) remaining on the photosensitive drum 211 after the transferring step.

The recording material P stored in the cassettes 261 and 262 is sent out on a sheet basis with a pickup roller 263 respectively and is supplied onto the conveyance belt 251 with supplying rollers 265 and 266. The supplied recording material P is charged with an attraction charger 253. The conveyance belt 251 is moved with the drive roller 252. In addition, the drive roller 252 and the attraction charger 253 make a pair and are caused to charge the recording material P to cause the conveyance belt 251 to attract the recording material P. In addition, the recording material tip sensor 267 detects the tip of the recording material P on the conveyance belt 251. The detected signal of the recording material tip sensor 267 is transmitted from the printer unit 200 to the reader unit 300 and is used as a vertical scan synchronization signal at an occasion when a video signal is transmitted from the reader unit 300 to the printer unit 200.

Thereafter, the conveyance belt 251 conveys the recording material P and the first to fourth image forming units 210*a* to 210*d* transfer a toner image on its surface in the order of magenta, cyan, yellow and black colors. The recording material P having passed the fourth image forming unit 210*d* undergoes charge elimination with a neutralization apparatus 254 in order to simplify separation from the conveyance belt 251 and thereafter is separated from the conveyance belt 251. In addition, a delamination charger 255 prevents the image from getting disordered due to delamination discharging at an occasion when the recording material P is separated from the conveyance belt 251.

Subsequently, in order to compensate the attracting force of toner to prevent disorder in images, the recording material P separated from the conveyance belt 251 is charged with the prefixing chargers 268 and 269. Subsequently, after a toner image is fixed by heat with the fixing device 217, the recording material P is discharged to a recording material discharge tray 218.

[Traveling Wave Motor]

Next, a drive unit of the photosensitive drum 211 in the image forming apparatus 101 of the present embodiment will be described. The present embodiment is adapted to include the drive unit of the photosensitive drums 211*a* to 211*d* of the respective image forming units 210*a* to 210*d* being substantially the same. Accordingly, the drive unit will be described in a collective manner without any particular differentiation for the respective image forming units 210*a* to 210*d*.

In the present embodiment, a traveling wave motor to be described below is used as drive unit for rotating the photosensitive drums 211*a* to 211*d* of the respective image forming units 210*a* to 210*d*. The traveling wave motor is called an ultrasonic motor in the case where oscillation thereof is intensified.

Figure 2:
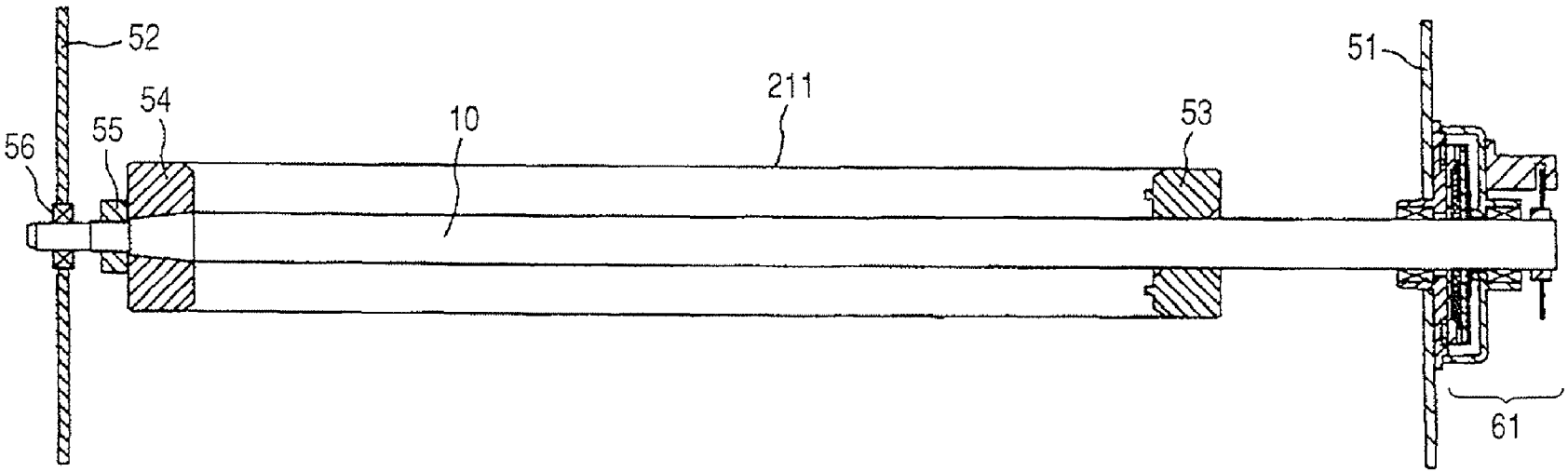
FIG. 2 is a section illustrating a configuration of a traveling wave motor, a photosensitive drum and the peripherals of the photosensitive drum which are related to the Embodiment 1.
Figure 3:
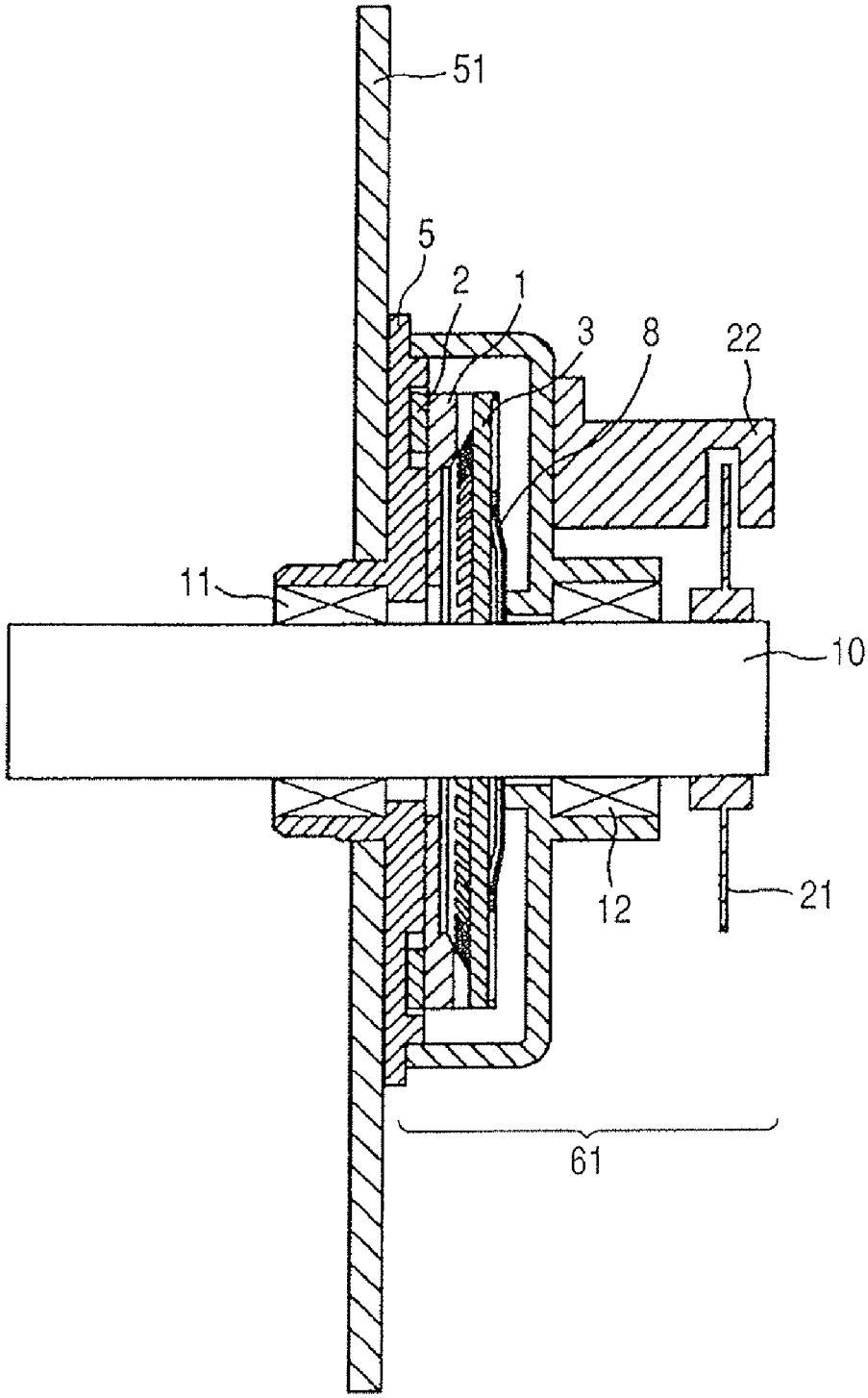
FIG. 3 is a section of the traveling wave motor related to the Embodiment 1.
Figure 4:
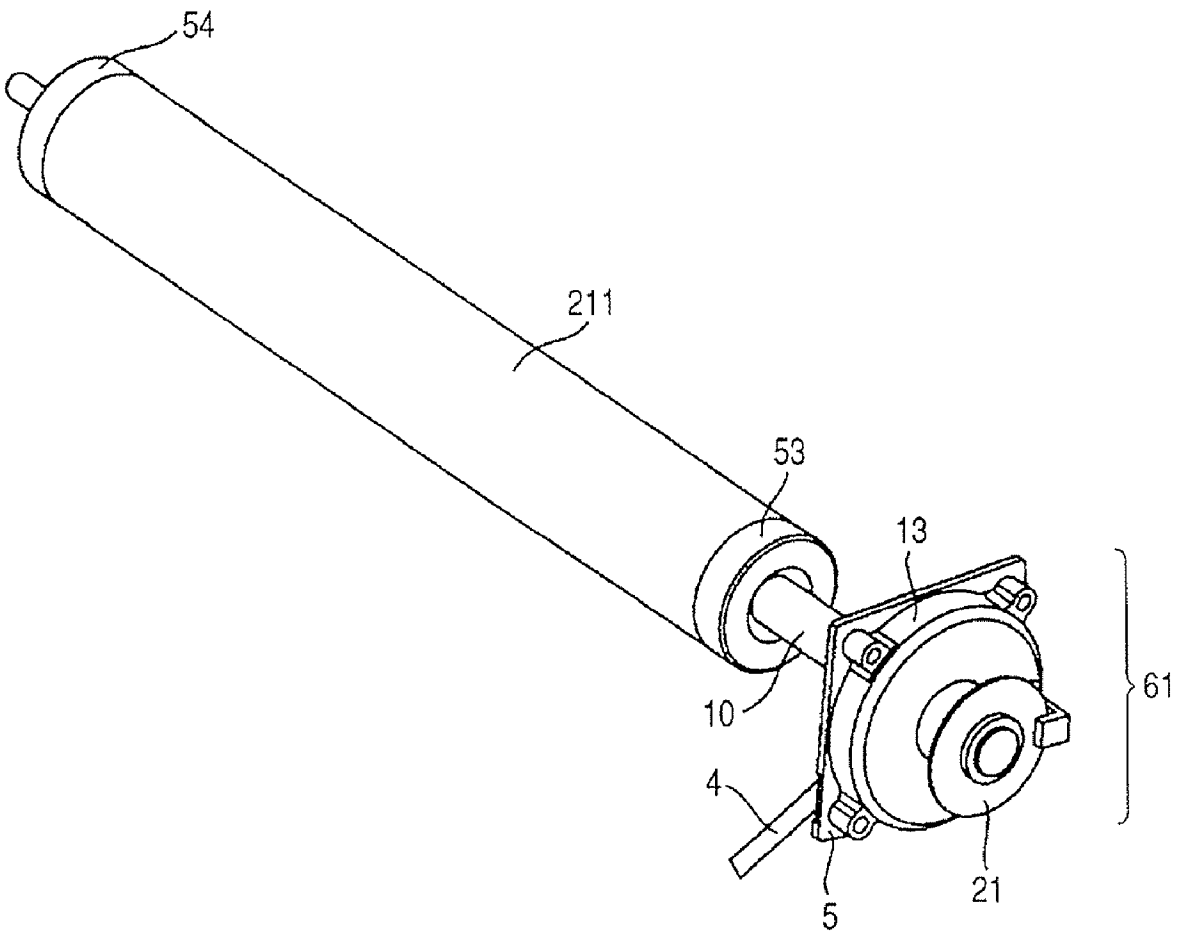
FIG. 4 is a perspective view describing a configuration of the traveling wave motor and the photosensitive drum which are related to the Embodiment 1.
Figure 5:
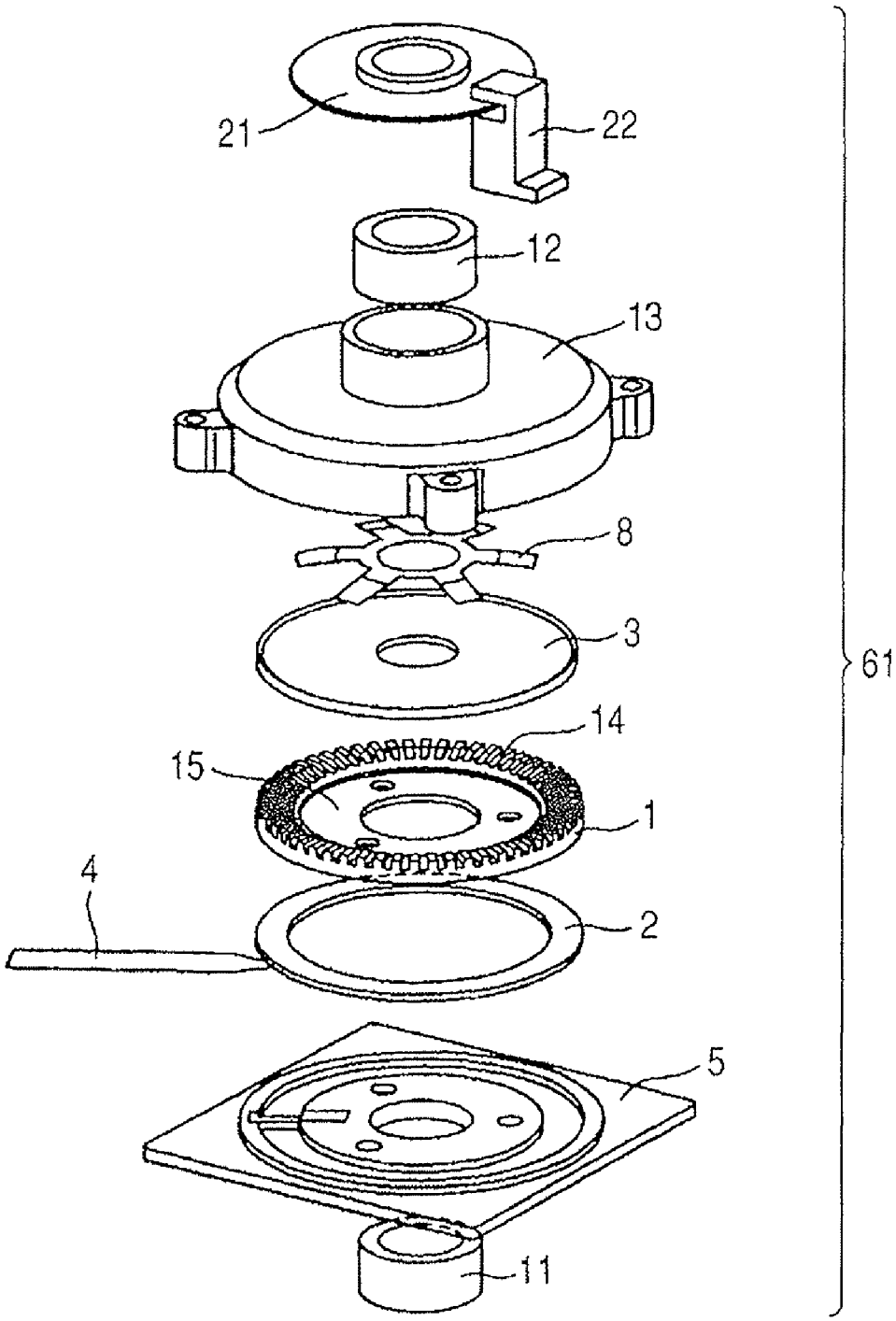
FIG. 5 is an assembly perspective view for describing components of the traveling wave motor related to the Embodiment 1.

FIG. 2 illustrates a section of the traveling wave motor 61, a photosensitive drum 211 and the periphery thereof. In addition, FIG. 3 illustrates the interior structure of the traveling wave motor 61 in FIG. 2. In addition, FIG. 4 illustrates an appearance of the traveling wave motor 61, the photosensitive drum 211 and the periphery thereof. Moreover, FIG. 5 illustrates interior components of the traveling wave motor 61.

As illustrated in FIG. 2 and FIG. 4, a first and a second drum flanges 53 and 54 are provided coaxially along a shaft 10 extended from the traveling wave motor 61. The present embodiment is adapted to include a drum shaft being a rotation axis of the photosensitive drum 211. Being fit into those first and second drum flanges 53 and 54, the photosensitive drum 211 is provided. In the present embodiment, the photosensitive drum 211 is removable from the shaft 10 integrally with the first and the second drum flanges 53 and 54 and is replaceable. As another embodiment, the shaft 10 may be prepared as another member of the drum shaft. It also achieves a similar effect to the present embodiment, as long as the shaft 10 engages with the drum shaft.

The second drum flange 54 and the shaft 10 are brought into contact in the surfaces respectively tapered so as to come in conformity each other and are screwed tightly with a lock nut 55. Thereby those tapered surfaces are fixed each other with pressure. The traveling wave motor 61 is fit in one of side plates (first fide plate) 51 of a first and a second side plates 51 and 52 which a frame of the image forming apparatus 101 comprises and is fixed with a screw (not illustrated in the drawing) as a fixing unit. The other side plate (second plate) 52 is provided with a bearing 56 which supports the shaft 10 rotatably in a fixed manner.

Here, as described below, the present embodiment changes the speed of the traveling wave motor 61 to decrease attraction force of the photosensitive drum 211 and toner. In that case, as described above, the traveling wave motor 61 and the photosensitive drum 211 are brought into direct connection. Thereby, in the present embodiment, also in the case where the image bearing member made to be the photosensitive drum 211 is highly rigid, the speed fluctuation can be transmitted to the toner efficiently.

As illustrated in FIG. 4, a flexible substrate 4, which transmits a drive signal to the traveling wave motor 61, is connected to the traveling wave motor 61.

Here, the oscillatory motor such as the traveling wave motor 61 is a motor of a non-electromagneticdrive type adapted as described below as already well known. That is, by applying alternating voltage to a piezoelectric element as an electro-mechanical energy conversion unit of an oscillation member, the above described element is caused to generate high frequency oscillation. That oscillatory energy is transmitted to a resilient member to form traveling wave of continuous resilient deformation generated on the surface of the resilient member. That traveling wave is taken out as machine motion.

The principle of operation itself of such an oscillatory motor has already been described in a lot of literature and the like. In brief description, a piezoelectric element for drive is arranged in a ring-like resilient oscillatory member of a traveling wave motor and alternating voltage for drive is applied to this piezoelectric element. Thereby the oscillatory member is caused to excite a predetermined oscillation mode. In addition, a piezoelectric element to which alternating voltage is applied to provide an appropriate time phase difference for oscillation is further arranged at a position different from the above described piezoelectric element. Thereby, elliptic motion is formed on the surface of the oscillatory member and thereby traveling wave is created. The above described oscillatory member and a contact member coming into press contact to the above described oscillatory member are caused to get driven by friction relatively with the above described elliptic motion. Here, for convenience, the above described one of the alternating voltage is called "A-phase signal". The other alternating voltage with a phase difference is called "B-phase signal". The A-phase and the B-phase alternating voltages are sinusoidal waves with the same amplitude basically with a phase difference of around 90°. In addition, the ring-like oscillatory member is generally called a stator and the contact member on the driven side is called as a rotor.

With reference to FIG. 3 and further FIG. 5, the interior structure of the traveling wave motor 61 of the present embodiment will be described further. The traveling wave motor 61 includes a resilient oscillatory member 1 formed of a flexible ring-like metallic elastic member (metal elastic member). The resilient oscillatory member 1 is appropriately produced, for example, with stainless steel and phosphor bronze. On one end surface (the left side in FIG. 3 and the lower side in FIG. 5) of the resilient oscillatory member 1, a piezoelectric element group 2 comprising two groups of piezoelectric elements polarized into a plurality of units respectively corresponding to the A-phase and B-phase formed to shape rings is concentrically adhered. With that piezoelectric element group 2, the surface on the side opposite to the surface where the piezoelectric element group 2 of the resilient oscillatory member 1 is pasted is adapted to generate traveling waves. On the surface of the resilient oscillatory member 1 where traveling waves are generated, a plurality of grooves 14 are formed regularly in a comb teeth shape in the circumference direction so as to enlarge amplitude of the above described elliptical motion in order to increase drive efficiency of the motor.

The above described flexible substrate 4 is fixed on the piezoelectric element group 2. In addition, an inner periphery portion 15 of the resilient oscillatory member 1 forms a thin disc. The resilient oscillatory member 1 is fixed onto a base 5 with a screw (not illustrated in the drawing) as a fixing unit in that inner periphery portion 15.

In addition, the traveling wave motor 61 includes a rotor 3 as a contact member coming into press contact to the resilient oscillatory member 1. The rotor 3 is brought into press contact to coaxially to the resilient oscillatory member 1 with a blade spring 8 as a pressing unit. The blade spring 8 is pressed toward the rotor 3 with a case 13 and fixed so as to retain the pressing force. In addition, the shaft 10 is inserted into a first bearing 11 fit in the base 5 and a second bearing 12 fit in the case 13 and is supported rotatably. Moreover, the shaft 10 is fit in the rotor 3 and fixed. The rotor 3 and the shaft 10 rotate integrally. In addition, in the present embodiment, the traveling wave motor 61 includes an encoder 21 fit in the shaft 10 and fixed thereto and a detecting unit 22 for detecting a rotary signal generated from the encoder 21. The traveling wave motor 61 undergoes accurate rotation control based on a signal from that detecting unit 22.

Thus, in the present embodiment, a conversion unit converting alternating voltage of voltage into traveling waves occurring on the surface of the elastic member is used as the drive unit driving the image bearing member in the direction of image forming, which is the drive unit generating a propelling power with those traveling waves. That is, in the present embodiment, the above described converting unit is adapted to include the piezoelectric element group 2 to which alternating voltage of voltage is applied and the resilient oscillatory member 1 caused to oscillate with the piezoelectric element group 2. The propelling power generated by the traveling waves converted with the converting unit is transmitted to the rotor 3 to function as a drive unit. In particular, in the present embodiment, the traveling wave motor 61 being the drive unit is a motor transmitting the rotary motion. In the present embodiment, the traveling wave motor 61 is connected directly to the photosensitive drum 11 without being mediated by a reduction mechanism. The traveling wave motor 61 (in further detail, the rotor 3 as a rotary motion transmitting unit) and the photosensitive drum 211 (further in detail, the shaft 10 as a rotary motion transmitted unit) are substantially the same in the rotary angular speed.

Figure 6:
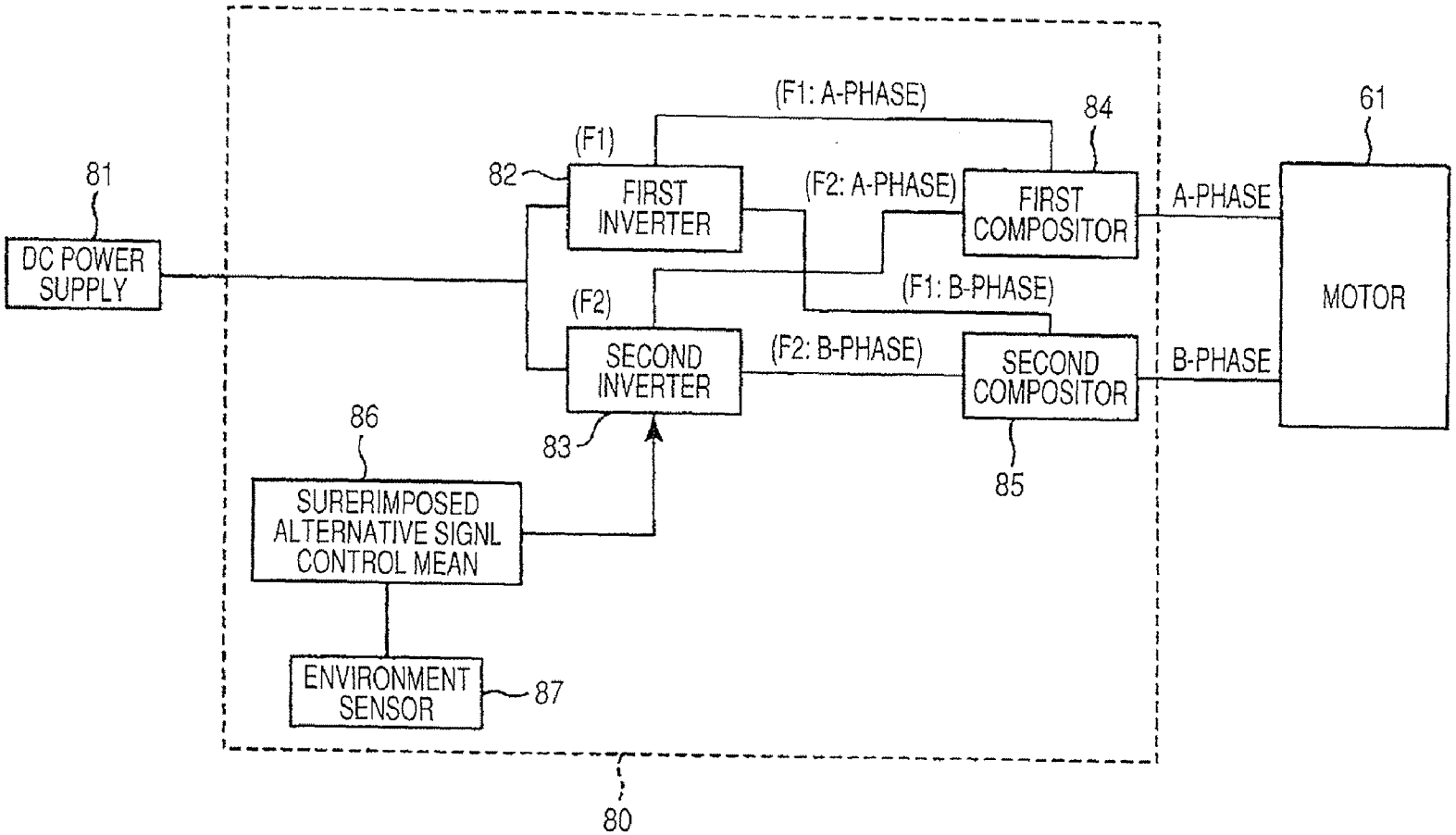
FIG. 6 is a block diagram illustrating a control unit of the traveling wave motor related to the Embodiment 1.

FIG. 6 illustrates a control unit of a traveling wave motor 61 of the present embodiment. Alternate voltage of the A-phase and the B-phase is applied to the traveling wave motor 61 through a flexible substrate 4. The control unit of the traveling wave motor 61 includes an alternating voltage control unit 80 and a DC power supply 81. The alternating voltage control unit 80 includes a first inverter 82 generating base voltage (hereinafter to be referred to as "base alternating voltage") F1 for carrying out base speed drive of the traveling wave motor 61 with the DC power supply 81. In addition, the alternating voltage control unit 80 as a driver includes a second inverter 83 generating oscillatory voltage (hereinafter to be referred to as "superimposed alternating voltage") F2 to be superimposed to the base alternating voltage with the DC power supply 81. In addition, the alternating voltage control unit 80 includes a first compositor 84 composing only A-phase signals from a first and a second inverters 82 and 83 and a second compositor 85 composing only B-phase signals from a first and a second inverters 82 and 83.

Here, the base speed drive is to drive the traveling wave motor 61 so that the speed (rotational speed, surface motion speed and peripheral speed) of the photosensitive drum 211 is the speed of image forming in the case of carrying out only that base speed drive. That is, the base speed drive is the drive of the traveling wave motor 61 for moving the surface of the photosensitive drum 211 substantially at a constant base movement speed (base speed) Vd in the case where no intended speed fluctuation to be described below is carried out.

In addition, in the present embodiment, the alternating voltage control unit 80 includes an environment sensor 87 as an environment detecting unit detecting one of temperature and moisture inside the image forming apparatus 101 and otherwise the both of temperature and moisture. In the present embodiment, the alternating voltage control unit 80 includes a superimposed alternating voltage control unit 86 controlling one of frequency and amplitude of superimposed alternating voltage F2 based on outputs from an environment sensor 87.

The first inverter 82 generates the base alternating voltage F1 (F1A and F1B) with frequency f1 in the A-phase and the B-phase. In the present embodiment, the base speed Vd is determined by the amplitude m1 of the base alternating voltage F1 (F1A and F1B).

On the other hand, the second inverter 83 generates superimposed alternating voltage F2 (F2A and F2B) with frequency f2 in the A-phase and the B-phase. The alternating voltage with respective frequencies of f1 and f2 in the A-phase and the B-phase is composed by respective compositors 84 and 85 and is applied to the traveling wave motor 61. That is, the first compositor 84 composes the base alternating voltage F1A and the superimposed alternating voltage F2A to form the alternating voltage in the A-phase. In addition, the second compositor 85 composes the base alternating voltage F1B and the superimposed alternating voltage F2B to form the alternating voltage in the B-phase.

Here, the frequency f2 of the superimposed alternating voltages F2A and F2B is caused to provide a difference from the frequency f1 of the base alternating voltages F1A and F1B. Thereby it is possible to apply so-called amplitude modulation to the base alternating voltages F1A and F1B.

The alternating voltage in the A-phase and B-phase, in which the base alternating voltage is modulated by the superimposed alternating voltage and is applied to the piezoelectric element group 2 of the traveling wave motor 61 will also be called as "motor drive signal" below. In addition, in the present embodiment, the motor drive signals respectively in the A-phase and the B-phase are provided with phase difference each other but are regarded the same in waveform itself. Accordingly, in the case where no differentiation is required in particular, the characters A and B specifying the A-phase and the B-phase respectively will be omitted and either one of the signals will be described.

Specific values will be exemplified. The frequency f1 of the base alternating voltage F1 is 30 kHz, the sinusoidal amplitude m1 of the base alternating voltage F1 is 100 V (that is, the alternating voltage falling within the range of not less than −100 V and not more than +100 V). The frequency f2 of the superimposed alternating voltage F2 is 40 KHz. The sinusoidal amplitude m2 of the superimposed alternating voltage F2 is 20 V (that is, the alternating voltage falling within the range of not less than −20 V and not more than +20 V).

Figure 7A:
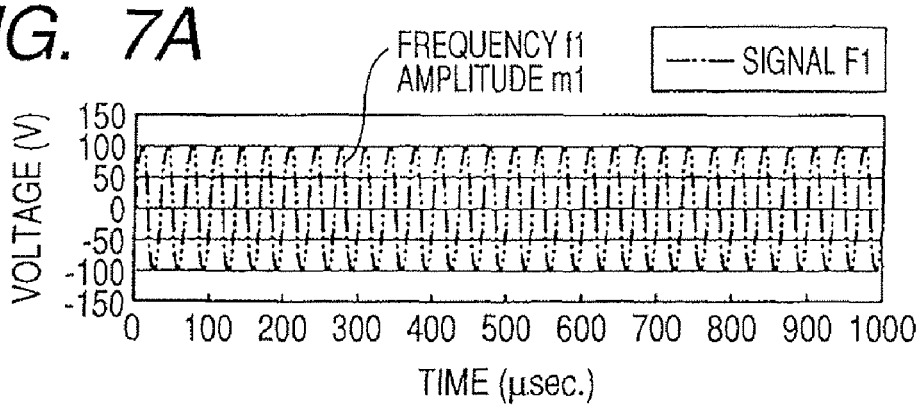
FIGS. 7A, 7B and 7C are graphs for describing an example of alternating signal applied to the traveling wave motor related to the Embodiment 1.
Figure 7B:
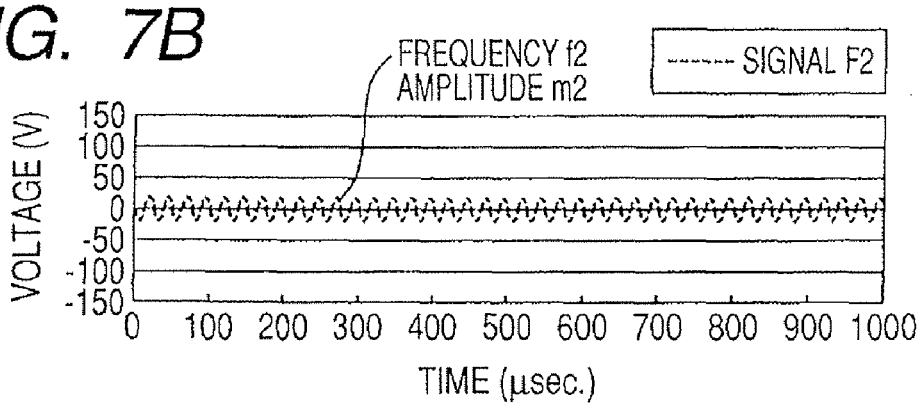
Figure 7C:
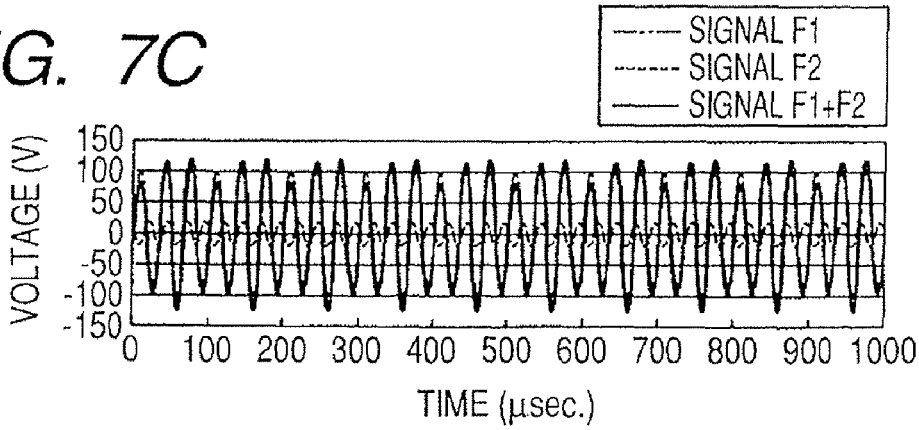

FIGS. 7A, 7B and 7C depict signals of either one of the A-phase and the B-phase at that occasion. In FIGS. 7A and 7C, the base alternating voltage F1 is illustrated with a dashed-two dotted line. In FIGS. 7B and 7C, the superimposed alternating voltage F2 is illustrated with a dashed line. The motor drive signal F1+F2 applied to the traveling wave motor 61 is illustrated with a full line (FIG. 7C). As illustrated in the drawing, the motor drive signal F1+F2 is formed by causing the sinusoidal wave of the base alternating voltage F1 to undergo amplitude modulation as described above by superimposing the superimposed alternating voltages F2 thereon.

Here, the peripheral speed (base speed) Vd of the photosensitive drum 211 is considered in the case of driving the traveling wave motor 61 only with the base alternating voltage F1 illustrated in FIGS. 7A, 7B and 7C. Application of the base alternating voltage F1 of 100 V will enable elliptic motion with amplitude a being 1 μm on the resilient oscillatory member 1. Under the condition with no load, the diameter Dr of the rotor 3 being 30 mm and the diameter Dd of the photosensitive drum 211 being 30 mm, the peripheral speed (base speed) Vd of the photosensitive drum 211 is calculated with the following formula (1) to derive 188 mm/s.

$$Vd=2\times\pi\times f1\times a\times(Dd/Dr)=188\text{ mm/s} \quad \text{(Formula 1)}$$

Figure 8:
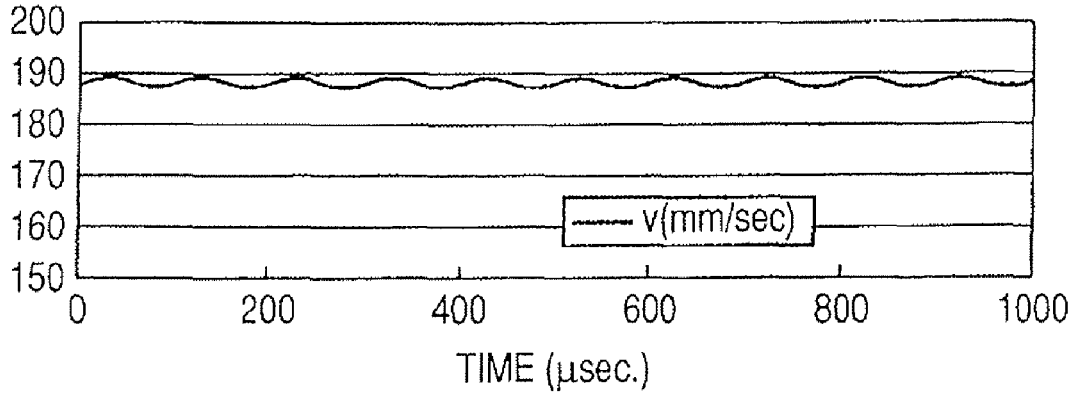
FIG. 8 is a graph for describing circumferential velocity of the traveling wave motor related to the embodiment 1.

Next, suppose that the motor drive signal F1+F2 illustrated in FIGS. 7A, 7B and 7C drives the traveling wave motor 61. In that case, the peripheral speed of the photosensitive drum 211 is modulated to appear as illustrated in FIG. 8.

Here, the frequency of fluctuation of the photosensitive drum 211 in speed is |f2−f1|=10 KHz. On the surface of the photosensitive drum 211 rotating at the peripheral speed (base speed) of Vd=188 mm/s in the base speed drive, the surface movement amount of the photosensitive drum 211 for a period of speed fluctuation (hereinafter to be referred to as "speed fluctuation period") is calculated with the following Formula (2) to derive 19 μm.

$$Vd/|f2-f1|=19[\mu m] \quad \text{(Formula 2)}$$

Such a speed fluctuation period is suitable as speed fluctuation period for reducing adhesion of toner generally with diameter of 5 to 7 μm to the photosensitive drum 211. Moreover, distortion in the toner image (transfer image) transferred onto the recording material P due to that fluctuation can be made small. According to the review of the present inventor, the speed fluctuation period thereof is appropriately not less than 10 μm. The shorter speed fluctuation period may extend the effect of reducing the adhesion of toner from the photosensitive drum 211 less remarkably. The more appropriate speed fluctuation period is not less than 15 μm. On the other hand, the more appropriate speed fluctuation period thereof is not longer than 100 μm. The longer speed fluctuation period may give rise to distortion in the transfer image. The more appropriate speed fluctuation period is not longer than 70 μm.

The volume of a speed fluctuation on the surface of the photosensitive drum 211 (also referred to as "amplitude of speed fluctuation" here) can be controlled easily with the amplitude m2 of the superimposed alternating voltages F2 generated by the second inverter 83. In general, as the amplitude m2 of the superimposed alternating voltages F2 gets larger, the volume (amplitude) of a speed fluctuation on the surface of the photosensitive drum 211 will get larger. On the contrary, as the amplitude m2 of the superimposed alternating voltages F2 gets smaller, the volume (amplitude) of a speed fluctuation on the surface of the photosensitive drum 211 will get smaller. In the case where the amplitude m2 of the superimposed alternating voltages F2 is 20 V in the above described example illustrated in FIG. 8, the volume (amplitude) of a speed fluctuation on the surface of the photosensitive drum 211 is 2 mm/s (that is, the fluctuation falling in the range of not less than −1 mm/s and not more than +1 mm/s).

Here, according to the review of the present inventor, the volume (amplitude) of a speed fluctuation on the surface of the photosensitive drum 211 is appropriately set as follows. The appropriate volume (amplitude) of a speed fluctuation hereof is not less than 0.3% of the base movement speed of the surface of the photosensitive drum 211, that is, not less than 0.6 mm/s (the fluctuation falling within the range of not less than −0.3 mm/s and not more than +0.3 mm/s) in the case of Vd=188 mm/s. The smaller speed fluctuation may extend the effect of reducing the adhesion of toner from the photosensitive drum 211 less remarkably. The more appropriate volume of a speed fluctuation is not less than 0.5%, that is, not less than 1 mm/s (the fluctuation falling within the range of not less than −0.5 mm/s and not more than +0.5 mm/s) in the case of Vd=188 mm/s. On the other hand, the appropriate volume (amplitude) of a speed fluctuation hereof is not more than 5% of the base speed or the base movement speed of the surface of the photosensitive drum 211 here, that is, not more than 9.4 mm/s (the fluctuation falling within the range of not less than −4.7 mm/s and not more than +4.7 mm/s) in the case of Vd=188 mm/s. The larger speed fluctuation period may give rise to distortion in the transfer image. The more appropriate speed fluctuation is not more than 3%, that is, not less than 5.6 mm/s (the fluctuation falling within the range of not less than −2.8 mm/s and not more than +2.8 mm/s) in the case of Vd=188 mm/s.

That is, in the present embodiment, the alternating voltage control unit 80 superimposes the second alternating voltage (superimposed alternating voltage) F2 subjected to desynchronization in frequency to the first alternating voltage F1 to the first alternating voltage (base alternating voltage) F1 carrying out drive operation at the base speed. Thereby, the alternating voltage with the first alternating voltage having undergone amplitude modulation is generated as the motor drive signal and can provide the traveling wave motor 61 with a fluctuation in speed. Thus, by providing alternating voltage for controlling the transfer performance is provided separately in addition to the alternating voltage for base speed drive, the control operation can be made easy.

In addition, as described above, since the volume of a speed fluctuation hereof can be easily controlled with the amplitude m2 of the superimposed alternating voltage F2 generated by the second inverter 83, control with high degree of freedom will become feasible.

As an example, the adhesion of toner to the photosensitive drum 211 varies according to an environmental fluctuation such as temperature and moisture. Even in such a case, the detection unit is used to so that the transfer performance can be retained.

In the present embodiment, as illustrated in FIG. 6, the alternating voltage control unit 80 is provided with the environment sensor 87. That environment sensor 87 detects and outputs one of temperature and moisture of the image forming apparatus 101 and otherwise the both of temperature and moisture. In receipt the output from that environment sensor 87, the superimposed alternative signal control unit 86 determines the amplitude m2 of the output voltage of the superimposed alternating voltage F2 in the second inverter 83 according to the output of that environment sensor 87. That is, a lookup table, which is assumed in advance based on prior measurement and the like, including setting value of the amplitude m2 of the superimposed alternating voltage F2 according to the adhesion of toner to the photosensitive drum 211 is stored in the memory (not illustrated in the drawing) built-in in the superimposed alternative signal control unit 86. Specifically, the lookup table hereof is stored in the memory of the superimposed alternative signal control unit 86 as information that relates the output of the environment sensor 87 to the amplitude m2 of the superimposed alternating voltage F2. The superimposed alternative signal control unit 86 reads the set value of the amplitude m2 of the superimposed alternating voltage F2 corresponding with the output of the environment sensor 87 from that lookup table to control the second inverter 83 to output the superimposed alternating voltage F2 with that amplitude m2. In general, the adhesion of toner to the photosensitive drum 211 get stronger under the environment with the low temperature and low moisture than under the environment with high temperature and high moisture. Accordingly, in that case, the amplitude m2 of the superimposed alternating voltage F2 is made larger under the environment with the low temperature and low moisture than under the environment with high temperature and high moisture and thereby the amplitude of a speed fluctuation of the photosensitive drum 211 is made larger.

More specifically, for example, the environment sensor 87 is a temperature/moisture sensor and detects to output the temperature/moisture environment of the atmosphere of the image forming apparatus 101. In that case, the superimposed alternative signal control unit 86 calculates the absolute water amount in the environment of the image forming apparatus 101 based on the output of the environment sensor 87. In addition, a lookup table including the relation between the absolute water amount of the environment of the image forming apparatus 101 and the amplitude m2 of the superimposed alternating voltage F2 is stored in the memory of the superimposed alternative signal control unit 56.

Such a method will enable the transfer performance to be maintained by causing the amplitude m2 of the superimposed alternating voltage F2 for the environment fluctuation. Thereby, also in the case where the adhesion of toner varies from hour to hour, the transfer performance can be secured more concretely.

Here, in the present invention, according to the environment (temperature and moisture and otherwise one of temperature and moisture) of the image forming apparatus 101, the amplitude m2 of the superimposed alternating voltage F2 is controlled but the present invention will not be limited thereto. On the control of that superimposed alternating voltage F2, various applications are considered. The alternating voltage control unit 80 is preferably designed to measure and otherwise predicts the cause of the adhesion between to the image bearing member and toner of the toner image formed on the image bearing member to control the alternating voltage applied to the drive unit. The control the adhesion by measurement and otherwise prediction specifically includes the following modes. That is, the image forming apparatus 101 measures the adhesion directly to enable control of the alternating voltage according to the adhesion thereof. In addition, the alternating voltage can be controlled based on the relation between parameters on the adhesion obtained by measurement and the like in advance and the set value of the alternating voltage.

For example, instead of detecting the environment of the image forming apparatus 101 with the environment sensor 87 as described above, one of the charge potential and the exposure potential on the photosensitive drum 211 is preferably measured to estimate the adhesion between toner and the photosensitive drum 211. In that case, the alternating voltage control unit 80 can control the amplitude m2 of the superimposed alternating voltage F2 according to the detection result of the potential sensor based on the relation between one of the charge potential and the exposure potential on the photosensitive drum 211 obtained by measurement and the like in advance and the amplitude m2 of the superimposed alternating voltage F2. The information describing that relation is stored in advance in the memory provided in the alternating voltage control unit 80 as a lookup table and the like likewise above. In general, in the legitimate developing system exposing the image portion, for example, one of the case where the charge potential is low and the case where difference between the exposure potential and the charge potential is large will provide stronger adhesion of toner to the photosensitive drum 211. Accordingly, in that case, enlarging the amplitude m2 of the superimposed alternating voltage F2 one of the case where the charge potential is low and the case where difference between the exposure potential and the charge potential is large, the volume (amplitude) of the speed fluctuation of the photosensitive drum 211 is enlarged. In addition, according to the type of the recording material P on which an image is formed at last, the amplitude m2 of the superimposed alternating voltage F2 can be controlled. In that case, the alternating voltage control unit 80 can determine the type of the recording material P used for image forming to estimate the relative adhesion of toner to the photosensitive drum 211 and the recording material P. Based on the relation between the type of the recording material P obtained by measurement and the like in advance and the amplitude m2 of the superimposed alternating voltage F2, the amplitude m2 of the superimposed alternating voltage F2 can be controlled according to the type of the recording material P. The information describing that relation is stored in advance in the memory provided in the alternating voltage control unit 80 as a lookup table and the like likewise above. In addition, the alternating voltage control unit 80 can determine the type of the recording material P with a signal for selecting the recording material P input from one of an operation unit of the image forming apparatus 101 and an operation unit of an external appliance such a personal computer connected to the image forming apparatus 101 in a communicable manner. Otherwise, the alternating voltage control unit 80 can determine the type of the recording material P with a signal for detecting the type of the recording material P input from the recording material type detecting unit provided in the image forming apparatus 101. As a recording material type detecting unit, the one detecting thickness and surface property, for example, of the recording material P based on the mechanical property and the optical property is nominated. In general, in the case where the recording material P is thick and the surface property is flat and smooth, the adhesion of toner to the photosensitive drum 211 will get stronger. Accordingly, in that case, the amplitude m2 of the superimposed alternating voltage F2 in the case where the recording material P is thick and the surface property is high, is made large to enlarge the volume (amplitude) of a speed fluctuation of the photosensitive drum 211.

Thus, the alternating voltage control unit 80 can be designed to control the alternating voltage signal output to the drive unit corresponding with the factor causing the adhesion of toner to one of the surface bearing toner prior to transfer and the surface bearing toner after transfer.

Detecting and otherwise determining environment, potential and otherwise the type of the recording material P as described above largely contributing to the adhesion of toner to the photosensitive drum 211, the amplitude of the output voltage of the superimposed alternating voltage can be controlled. And otherwise, detecting and otherwise determining all of them, the amplitude of the output voltage of the superimposed alternating voltage can be appropriately controlled.

Moreover, the image forming apparatus 101 with a plurality of types (four colors in the present embodiment) of toner as in the present embodiment occasionally different in charge performance in each type (color). Consequently, difference in the adhesion of toner to the photosensitive drum 211 occasionally takes place. In such a case, the amplitude m2 of the superimposed alternating voltage F2 can be determined on toner type (color) basis. Thereby, typically, even without varying transfer current flowing in the transfer roller 215 at the time of transfer on a toner type (color) basis, transfer performance appropriate for each toner is obtainable.

Here, in the above description, the amplitude m2 of the superimposed alternating voltage F2 is controlled in a variable manner but the frequency f2 of the superimposed alternating voltage F2 can be controlled in a variable manner. A specific example of varying the frequency f2 of the superimposed alternating voltage F2 will be described later. Thereby, varying the surface movement amount of the photosensitive drum 211 for a period of a speed fluctuation, that is, the speed fluctuation period, the operating volume of oscillating given to the toner can be changed.

Thus, in the present embodiment, the drive unit of the photosensitive drum 211 uses a conversion unit for converting the alternating voltage of voltage into the traveling wave occurring on the surface of the resilient member to generate propelling power with that traveling wave. And, the image forming apparatus 101 comprises the alternating voltage control unit 80 for providing the speed of the drive unit with a fluctuation by controlling the alternating voltage to control the period as well as volume (amplitude) of that speed fluctuation.

Figure 9A:
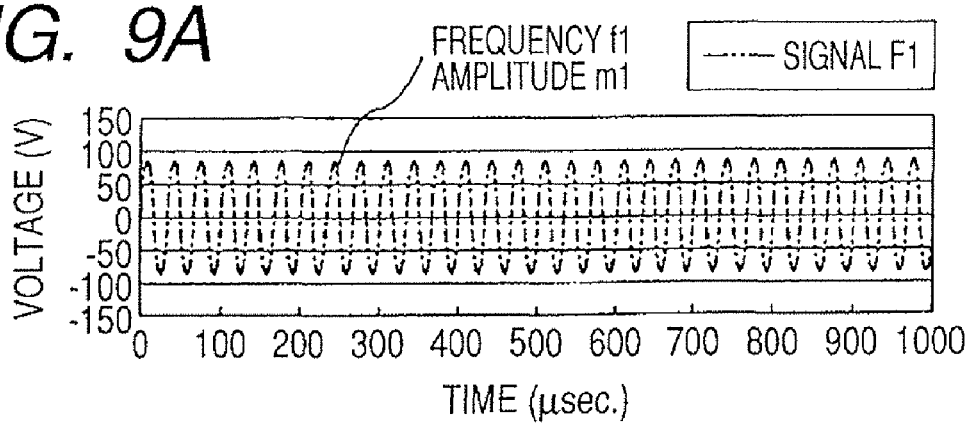
FIGS. 9A, 9B and 9C are graphs for describing the other examples of alternating signals applied to the traveling wave motor related to the Embodiment 1.
Figure 9B:
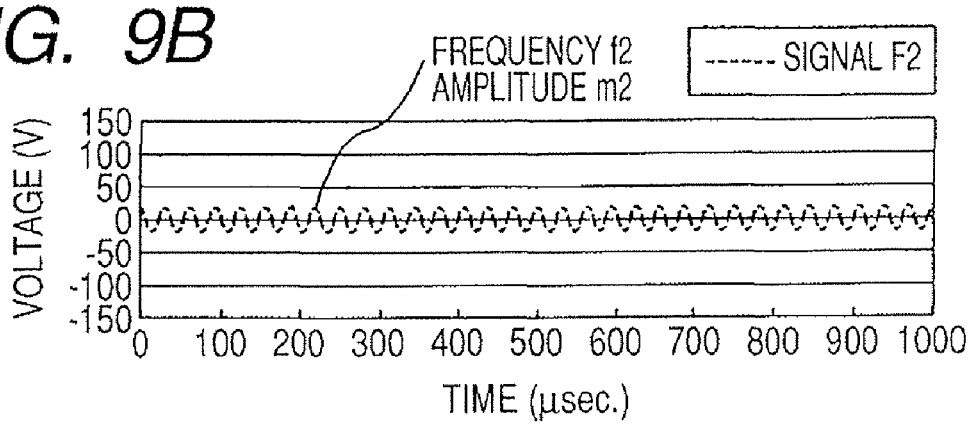
Figure 9C:
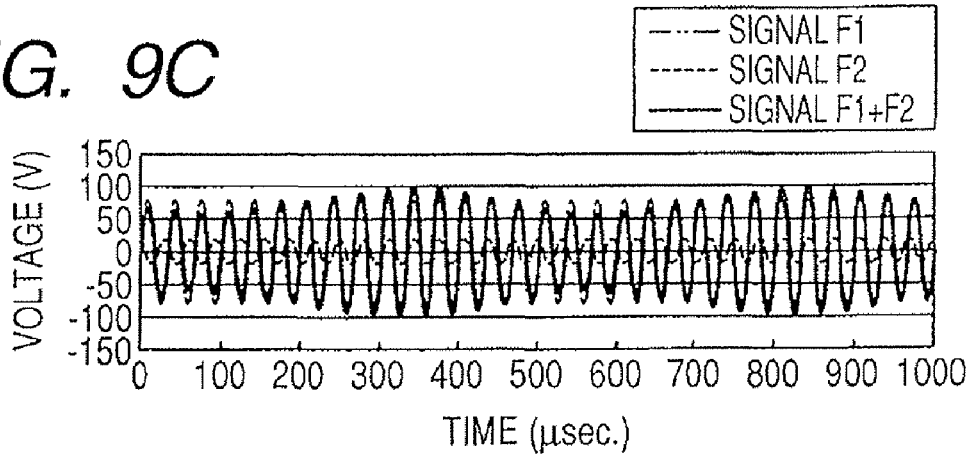

Next, the speed of the photosensitive drum 211 in the base speed drive, that is, the base movement speed (base speed) is varied will be reviewed. That is, this is to vary the circumferential velocity of the photosensitive drum 211 to vary the output speed (image forming speed) of an image. A general image forming apparatus of an electrophotography system varies time required for fixing toner onto the recording material P due to the type and otherwise thickness of the recording material P and therefore is frequently provided with a function of lowering the output speed at an occasion of forming an image onto the recording material P that requires time for fixing. In the present embodiment, variation in speed (base speed) of the photosensitive drum 211 in the base speed drive can be controlled with the voltage amplitude m1 of the base alternating voltage F1 input to the traveling wave motor 61 as described above. FIGS. 9A, 9B and 9C illustrate the waveform of the motor drive signal in the case where the motor drive signal illustrated in FIGS. 7A, 7B and 7C has varied in speed of the photosensitive drum 211 in the base speed drive (base speed). Here, FIGS. 9A, 9B and 9C depict signals of either A-phase or B-phase of the alternating voltage.

In FIGS. 9A and 9C, frequency f1 of the base alternating voltage F1 is illustrated with dashed-two dotted line has undergone no change in the above described one illustrated in FIGS. 7A, 7B and 7C and is 30 KHz. On the other hand, the amplitude m1 of the base alternating voltage F1 is altered from the above described 100 V (that is, the alternating voltage falling within the range of not less than −100 V and not more than +100V) to 80 V (that is, the alternating voltage falling within the range of not less than −80 V and not more than +80V).

Here, it depends on the configuration of the traveling wave motor 61, but altering the amplitude m1 of the base alternating voltage F1 is altered from 100 V to 80 V as described above and, thereby, the circumferential velocity (base speed) of the photosensitive drum 211 is assumed to be successfully altered from the default Vd=188 mm/s (at m1=100 V) to the 50% circumferential speed Vd'=99 mm/s. In that case, the frequency f2 of the superimposed alternating voltage F2 remain to be 40 KHz, the frequency of the speed fluctuation of the photosensitive drum 211 is |f2−f1|=10 KHz with no change. Therefore, on the surface of the photosensitive drum 211, the speed fluctuation period is calculated with the following Formula (3) to derive 11.4 μm.

$$Vd'/|f2-f1|=11.4[\mu m] \quad \text{(Formula 3)}$$

In the case of toner allowing no decrease in adhesion at that speed fluctuation period, the frequency f2 of the superimposed alternating voltage F2 generated by the second inverter 83 can be appropriately altered. As illustrated in FIGS. 9B and 9C, in the case where the frequency of the superimposed alternating voltage F2 is altered from f2=40 KHz to f2'=32 KHz, the frequency of the speed fluctuation of the photosensitive drum 211 will become |f2'−f1|=2 KHz. Thereby, on the surface of the photosensitive drum 211, the speed fluctuation period will be calculated with the following Formula (4) to derive 50 μm.

$$Vd'/|f2'-f1|=50[\mu m] \quad \text{(Formula 4)}$$

As for the change in frequency f2 of that the superimposed alternating voltage F2, an application example as follows can be considered. In the case of carrying out an alteration in the base speed, there was no problem with the base speed prior to alteration, but the case where the frequency of the speed fluctuation corresponds to the resonance frequency of respective elements inside the image forming apparatus 100 such as transfer belt 251, photosensitive drum 211 and the frames 51 and 52) is considered. In that case, according to the present embodiment, frequency f2 of the superimposed alternating voltage F2 is altered so as to enable frequency of speed fluctuation easily and, therefore, avoiding resonance frequency of each element, the range of alteration in the base speed can be taken larger.

Here the drive frequency of the traveling wave motor 61 is 30 KHz for description. The traveling wave with that frequency is so-called traveling wave. The traveling wave motor 61 of the present embodiment is also called as an ultrasonic motor. However, the present invention will not limit the drive frequency of traveling wave motors. Even in the case where a traveling wave motor driven with traveling wave other than the band used in the present embodiment or a surface acoustic wave motor, for example, with a drive frequency being not less than 10 MHz, implementation of the control completely equivalent to the present embodiment enables improvement in the transfer performance.

In addition, the base speed of the surface bearing the toner image of at least one photosensitive drum 211 while toner image transfer is going on at least can be substantially the same as and the movement speed of the surface where the toner image of the recording material P is transferred. Thereby, the distortion in the transfer image can be restrained.

Here, the base speed of the surface of the photosensitive drum 211 is normally represented by the average movement speed (average speed) of the surface of the photosensitive drum 211. That average speed typically corresponds to the speed of the center of the fluctuation width of the speed. In addition, normally the base speed of the photosensitive drum 211 corresponds to the image forming speed.

Moreover, the base speed of a plurality of photosensitive drums 211 (four units for the present embodiment) while toner image transfer is going on at least can be set to the speed substantially the same as the movement speed of the surface of the recording material P. Thereby, distortion in the transfer image is caused not to occur due to difference in speed and, in addition, no difference is caused to occur in behavior of the recording material P in a plurality of transfer portions (four portions for the present embodiment), enabling accuracy in superimposing a plurality of colors to get improved.

As described above, according to the present embodiment, alternating voltage of the motor drive signal applied to the traveling wave motor 61 being a drive unit is controlled to thereby provide the traveling wave motor 61 with fluctuation in speed and to control the period as well as the volume (amplitude) of that speed fluctuation. In particular, in the present embodiment, there is applied a motor drive signal generated by directly connecting the traveling wave motor 61 to the photosensitive drum 211 without a reduction mechanism to get driven and to superimpose the superimposed alternating voltage F2 to the base alternating voltage F1 in the traveling wave motor 61. Thereby, the speed fluctuation together with frequency as well as volume (amplitude) of the photosensitive drum 211 can be controlled easily. Accordingly, the transfer performance (transfer efficiency) can be improved with a simple configuration.

In addition, according to the present embodiment, the adaptive range is wide to fluctuation factor of adhesive of toner selected from the group consisting of environment, toner type, types of the recording material P and the like so as to enable improvement in the transfer performance.

In addition, the present embodiment can easily set the frequency of speed fluctuation in avoidance of resonant frequency of each element inside the image forming apparatus 100.

In addition, according to the present embodiment, oscillation is transmitted from the traveling wave motor 61 being a drive unit of the photosensitive drum 211 to the photosensitive drum 211. Accordingly, the present embodiment does not have to be provided with any separate oscillation applying unit such as a resonator, for example, so to be adapted simply. In addition, even in the case where the image bearing member to be provided with transferred oscillation is comparatively highly rigid, speed fluctuation of the traveling wave motor 61 being a drive unit is efficiently transmitted to the image bearing member, that is, the toner thereon to enable improvement in transfer performance. In particular, in the present embodiment, the traveling wave motor 61 being a drive unit is connected directly to the photosensitive drum 211. Thereby, the speed fluctuation of the traveling wave motor 61 being a drive unit is efficiently transmitted to the photosensitive drum 211 to enable improvement in effect for the transfer performance.

Embodiment 2

Next, a second embodiment related to the present invention will be described. An image forming apparatus of the present embodiment is basically adapted likewise the Embodiment 1. Accordingly, like reference characters designate the same as and otherwise equivalent to those elements of the embodiment 1 in function as well as configuration to omit detailed description.

The present embodiment is different from the Embodiment 1 in the portion related to the drive of the traveling wave motor 61 and otherwise the alternating voltage control unit to drive the traveling wave motor 61 in the more precise manner.

Embodiment 1 generates speed fluctuation of the photosensitive drum 211 as a result of modulating the amplitude of the alternating voltage applied to the traveling wave motor 61. The present embodiment modulates frequency to generate speed fluctuation of the photosensitive drum with the alternating voltage applied to the traveling wave motor 61 being set to the constant maximum amplitude.

Figure 10:
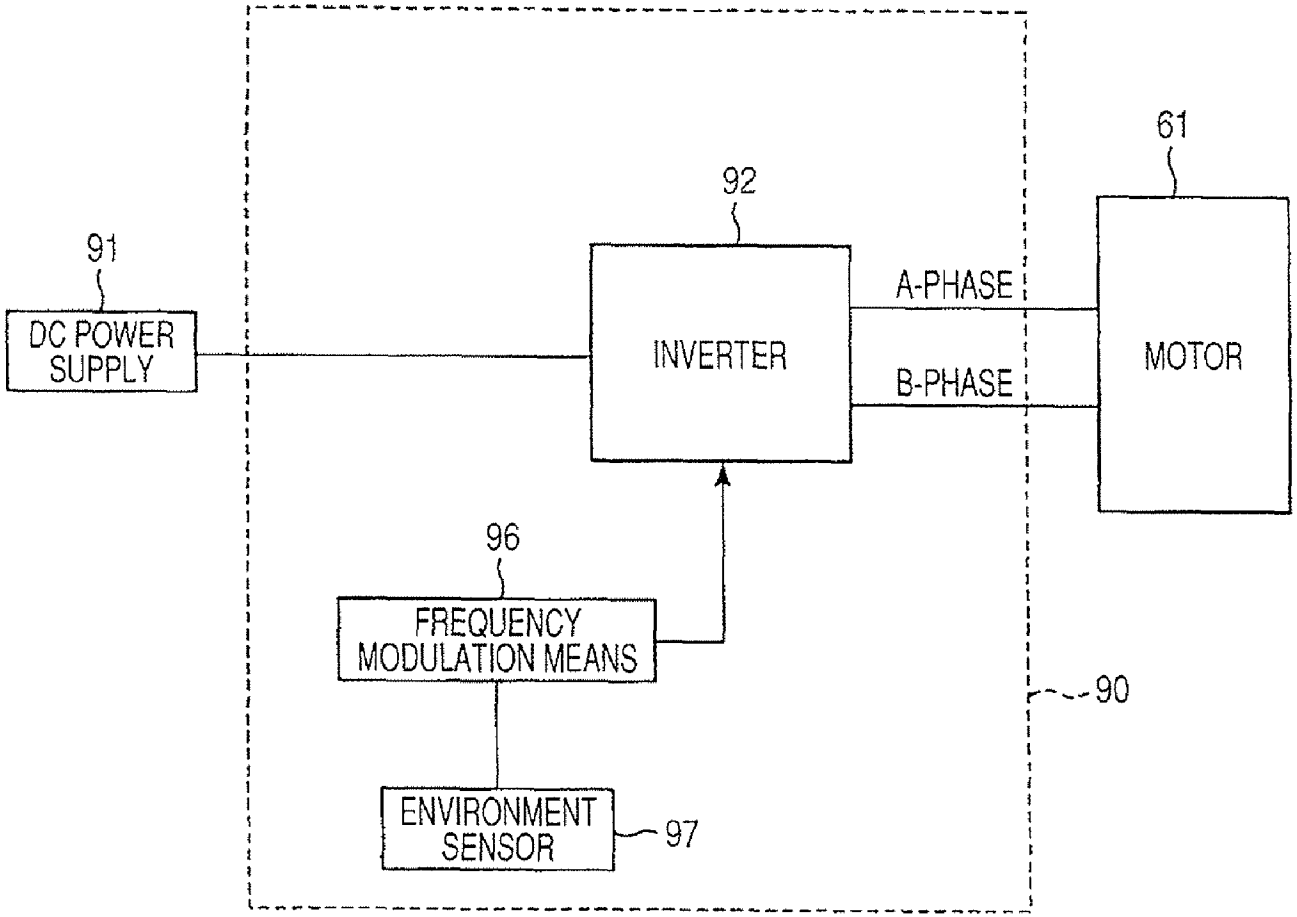
FIG. 10 is a block diagram illustrating a control unit of the traveling wave motor related to the Embodiment 2.

FIG. 10 illustrates a control unit of the traveling wave motor 61 of the present embodiment. A-phase and B-phase alternating voltage is applied to the traveling wave motor 61 through the flexible substrate 4 (see FIG. 4 and FIG. 5). The control unit of the traveling wave motor 61 includes an alternating voltage control unit 90 and a DC power supply 91. The alternating voltage control unit 90 includes an inverter 92 generating alternating voltage for driving the traveling wave motor 61 with the DC power supply 91. In addition, the alternating voltage control unit 90 includes a frequency modulation control unit 96 for modulating frequency of the alternating voltage generated by the inverter 92.

The inverter 92 generates the A-phase and B-phase alternating voltage for driving the traveling wave motor 61. However the alternating voltage hereof undergoes modulation with the frequency modulation with the frequency modulation control unit 96. In particular, in the present embodiment, the frequency modulation control unit 96 varies intensity of the frequency modulation of alternating voltage applied to the traveling wave motor 61 based on information of one of temperature and moisture and otherwise both of temperature and moisture obtained by an environment sensor 97. The environment sensor 97 likewise the one described in the Embodiment 1 is usable.

Figure 12:
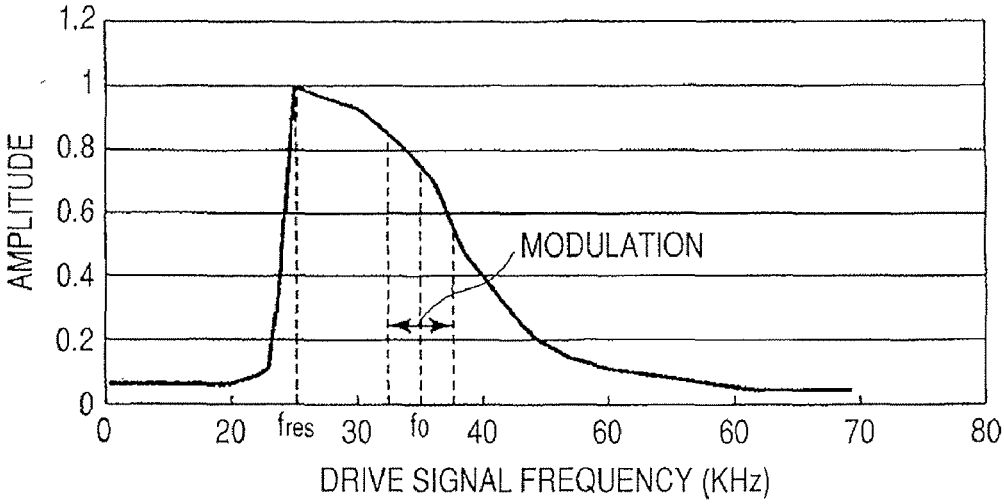
FIG. 12 is a graph for describing frequency characteristics of a piezoelectric element to drive the traveling wave motor related to the Embodiment 2.

Here, FIG. 12 illustrates an example of a frequency property of the piezoelectric element used in the traveling wave motor 61. In FIG. 12, the horizontal axis represents drive frequency and the vertical axis represents amplitude of the piezoelectric element. That amplitude is displayed by "1" in the case of drive at the resonance frequency fres.

Figure 11:
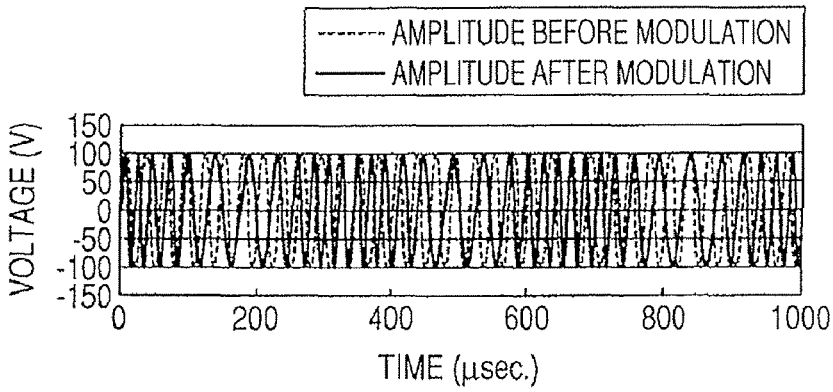
FIG. 11 is a graph for describing an example of alternating signals applied to the traveling wave motor related to the Embodiment 2.

Here, for the frequency fres, the center value of the frequency for base speed drive is set to a frequency fO in the amount of 35 KHz. For that frequency fO, the case of applying frequency modulation as described above is exemplified to provide alternating voltage waveform as in FIG. 11. Here, the modulation frequency in the mount of 3 KHz is adopted for operation.

In FIG. 12, discrepancy of the drive frequency from the frequency fO varies the amplitude itself of the piezoelectric element. Variation in amplitude of a piezoelectric element unit variation in circumferential velocity of the rotor 3 inside the traveling wave motor 61. Consequently it unit the circumferential velocity of a subject driven by the traveling wave motor 61.

In addition, as illustrated in FIG. 12, as frequency property of the piezoelectric element, the frequency of not more than the resonant frequency fres is steep in change of amplitude and is inappropriate for the case of generating accurate speed fluctuation with the frequency modulation. Accordingly, in the present embodiment, the drive is appropriately operated with frequency for base speed drive in the amount of fO>fres.

Thus, in the present embodiment, the alternating voltage control unit 90 modulates the alternating voltage frequency of the motor drive signal. Thereby, the traveling wave motor 61 is fluctuated in speed.

Here, also in the case where the alternating voltage of the motor drive signal in the present embodiment undergoes frequency modulation, arbitrary change in the modulation frequency enables change, likewise the Embodiment 1, in the both of the speed fluctuation period of an subject undergoing speed fluctuation and the volume (amplitude) of the speed fluctuation and otherwise one of the speed fluctuation period of an subject undergoing speed fluctuation and the volume (amplitude) of the speed fluctuation. In general, as the frequency modulation width of the modulation frequency gets larger, the volume (amplitude) of speed fluctuation on will get larger. On the contrary, as the frequency modulation width of the modulation frequency gets smaller, the volume (amplitude) of speed fluctuation on will get smaller. In addition, as the modulation period gets larger, the speed fluctuation period will get larger. On the contrary, as the modulation period gets smaller, the speed fluctuation period will get smaller.

As described above, according to the present embodiment, frequency modulation gives rise to speed fluctuation in the traveling wave motor 61 to enable a subject undergoing speed fluctuation, that is, the circumferential velocity of the photosensitive drum 211 in the present embodiment to get fluctuated. Improvement in effect for the transfer performance is obtainable likewise the Embodiment 1.

In addition, according to the present embodiment, the control unit can be adapted simpler than the Embodiment 1 and can improve transfer performance likewise the Embodiment 1. In addition, the frequency modulation control unit 96 can change the modulation frequency freely and, therefore, with the control in speed fluctuation based on various factors described in the Embodiment 1, likewise effect described in the Embodiment 1 is obtainable. For example, the present embodiment is widely applicable to fluctuation factor of adhesive of toner selected from the group consisting of environment, toner type, types of the recording material and the like so as to enable improvement in the transfer performance. In addition, the present embodiment can easily set the speed fluctuation frequency in avoidance of resonant frequency of each element inside the image forming apparatus.

Here, in the present embodiment, the alternating voltage control unit 90 described in the present embodiment was described for use as an alternative of an alternating voltage control unit controlling the drive for the traveling wave motor 61 in Embodiment 1 but nothing will be limited hereto. The alternating voltage control unit 90 described in the present embodiment is applicable to respective modes in an Embodiment 3 and an embodiment 4 to be described below so that an effect likewise above is obtainable.

Embodiment 3

Next, a third embodiment related to the present invention will be described. An image forming apparatus of the present embodiment is basically adapted likewise the Embodiment 1. Accordingly, like reference characters designate the same as and otherwise equivalent to those elements of the embodiment 1 in function as well as configuration to omit detailed description.

Figure 13:
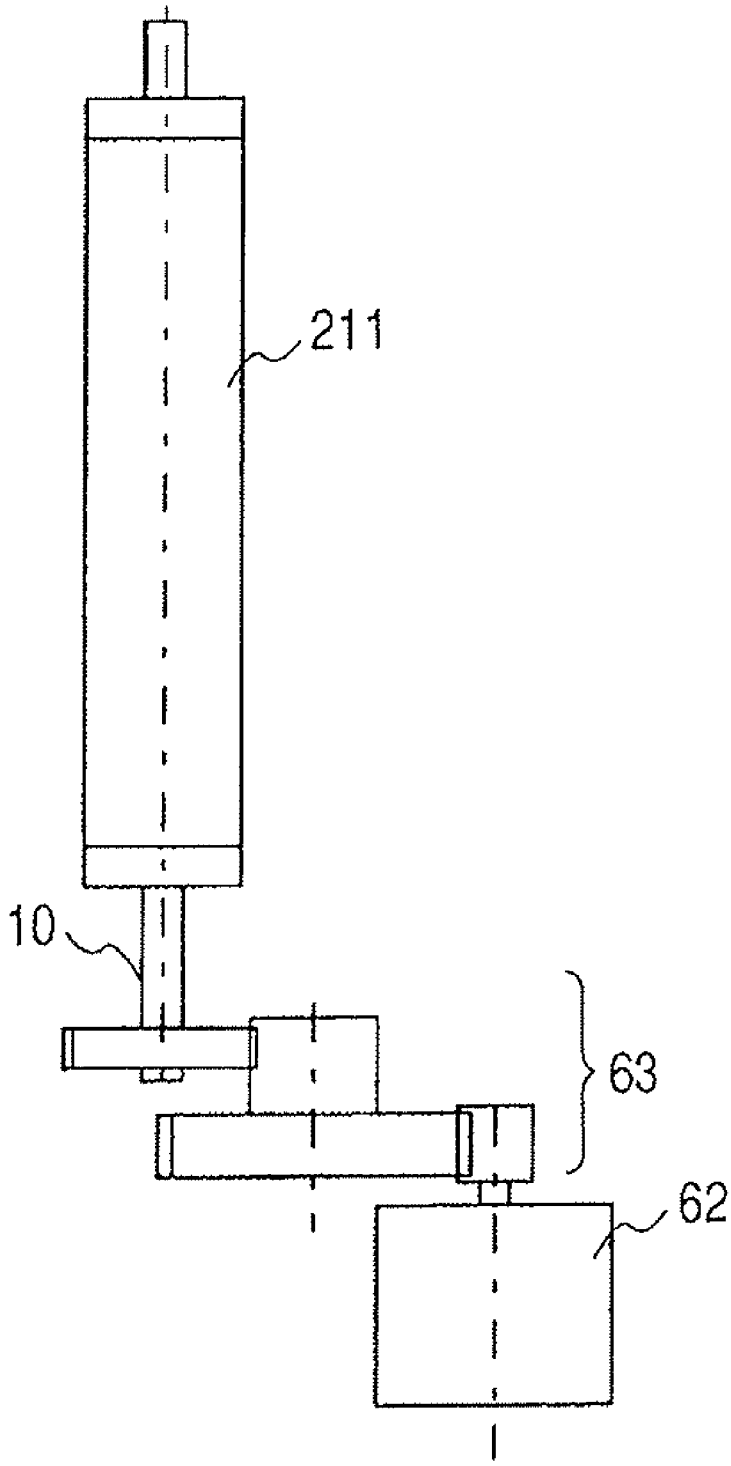
FIG. 13 is a diagram describing a configuration between a stepping motor related embodiment 3 and a train of reduction gears, a photosensitive drum and the photosensitive drum periphery.
Figure 14:
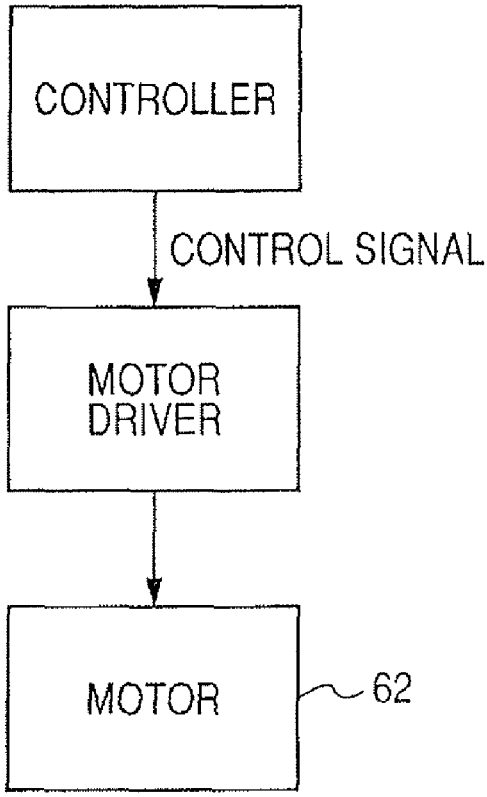
FIG. 14 is a diagram describing a method of driving a stepping motor related to an Embodiment 3.
Figure 15:
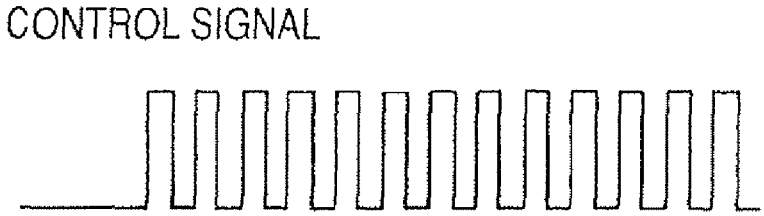
FIG. 15 is a diagram describing a drive signal of the stepping motor related to the Embodiment 3.
Figure 16:
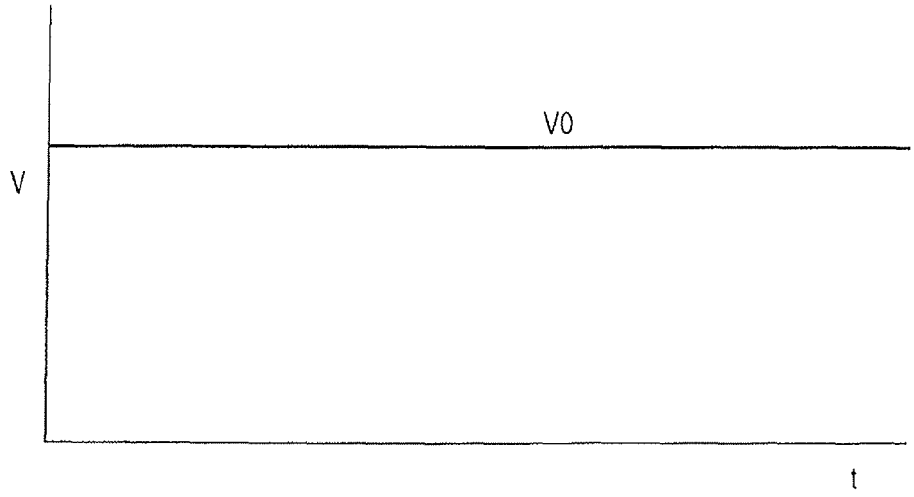
FIG. 16 is a graph describing a photosensitive drum rotational speed related to the Embodiment 3.

FIG. 13 schematically illustrates an appearance of the photosensitive drum 211, a supporting shaft 10, a train of gears 63 and a stepping motor 62, the stepping motor 62 carrying out reduction drive on the photosensitive drum 211 through the train of gears 63 in a state supported by the supporting shaft 10. In addition, FIG. 14 illustrates a flow of the stepping motor being driven by a control (drive) signal generated by a control unit through a motor driver. FIG. 15 illustrates a pulse row of the control signal to become the standard for driving the stepping motor. The pulse row having a constant period is input as the control signal, which an excitation current acts, as a standard, on each phase inside the motor with the motor driver so that the motor rotates at a substantially constant rotational speed to undergo gear reduction and the photosensitive drum rotates at a substantially constant speed V0. A graph illustrated in FIG. 16 includes a horizontal axis representing time and a vertical axis representing the speed v.

Here, the case of reduction drive with the stepping motor is basically a state of including intermittent switching fluctuation of excitation phase in the stepping motor 62. As for the fluctuation thereof, a state of rotary drive at rotary accuracy to a sufficiently ignorable extent (not more than around approximately 0.3 to 0.5% rms in speed fluctuation ratio wow and flatter value for 2000 to 3000 rpm) to is expressed as "substantially constant velocity VO".

Figure 17A:
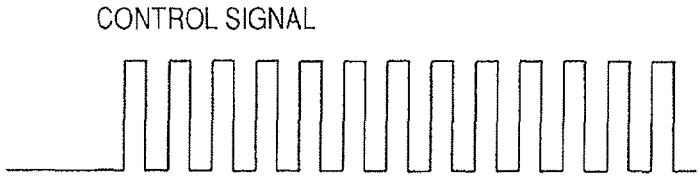
FIGS. 17A, 17B and 17C are graphs describing frequency control drive of the stepping motor related to the Embodiment 3.
Figure 17B:
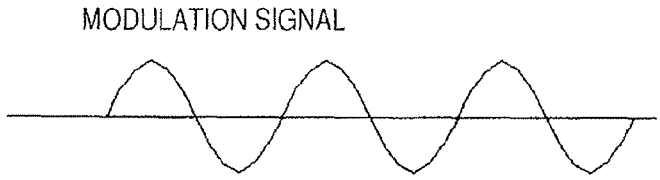
Figure 17C:
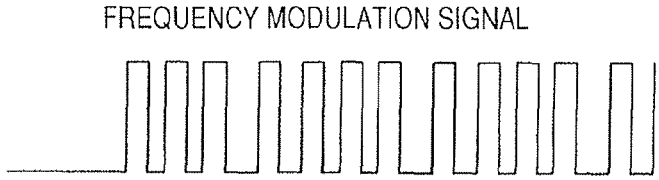

The above described general photosensitive drum mode for the mode of the present invention will be described with FIGS. 17A, 17B and 17C.

Figure 18:
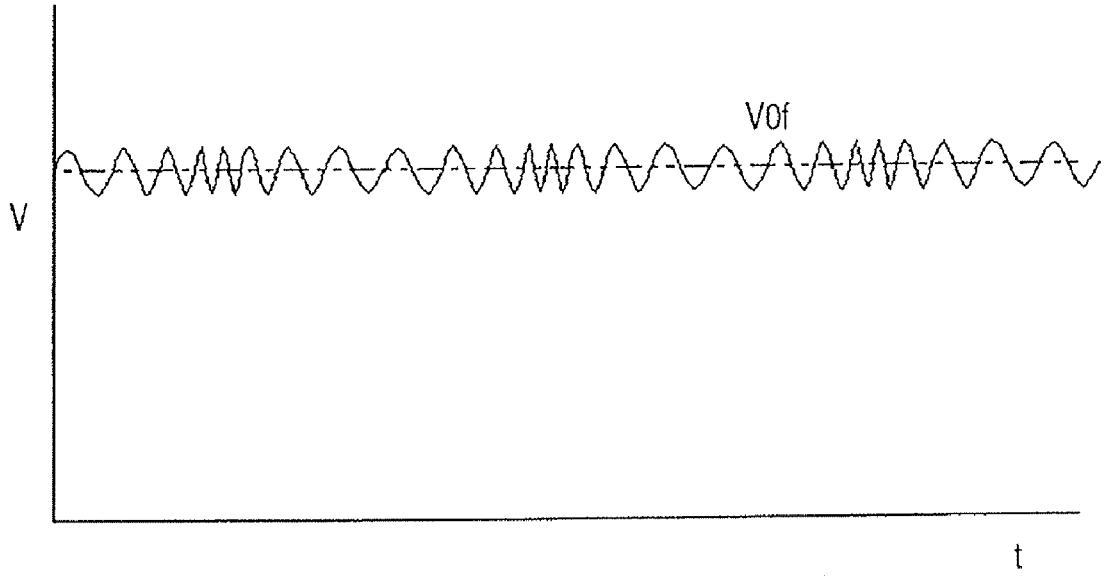
FIG. 18 is a graph describing a photosensitive drum rotational speed subjected to frequency modulation in the Embodiment 3.

For the control signal (FIG. 17A) being the base voltage described above, a modulation signal (FIG. 17B) including a predetermined frequency is prepared. The drive signal to become a standard with that modulation signal undergoes frequency modulation (FIG. 17C). Thereby, the control signal will enter a state with the control signal having undergone frequency modulation. The stepping motor is driven based on that frequency modulation signal. Then the state being driven at a constant velocity VO illustrated in FIG. 16 will enter a state of the velocity VOf with a predetermined velocity VO fluctuating at a frequency modulation period f as illustrated in FIG. 18 will enter the state of VOf. (The graphs are subjected to deformation in order to simplify the appearance of frequency modulation for discrimination. It goes without saying that the fluctuation percentage in the modulation speed should not be an amount of providing an image with fluctuation.)

As described in FIG. 18, a predetermined rotational speed can be provided with speed fluctuation. Therefore, at the time of transfer from the photosensitive drum to a transfer medium, transfer efficiency can be improved so as to nullify occurrence of adverse effects to an image such as transfer hollowness.

Moreover, the average circumferential speed of four photosensitive drums can be set so as to generates movements at a speed equivalent to the transfer medium such as recording sheet. That does not cause any distortion in transfer image to occur at the speed difference and does not give rise to any difference in the behavior of the transfer medium at in the transfer unit in the four sites so as to improve accuracy in superimposing four colors.

As described above, the present embodiment is adapted to include the photosensitive drum to undergo rotary drive with the stepping motor through the gear reduction mechanism and, moreover, is adapted to modulate the motor drive signal in frequency and thereby easily enable to control the photosensitive drum in speed fluctuation. Thereby, the transfer performance can be adapted to increase with simple adaptation. In addition, the adaptive range to fluctuation factor of adhesive of toner selected from the group consisting of environment, toner, type of paper and the like is wide so as to make the transfer performance securable.

Embodiment 4

Next, a fourth embodiment related to the present invention will be described.

[Entire Adaptation and Operation of Image Forming Apparatus]

Figure 19:
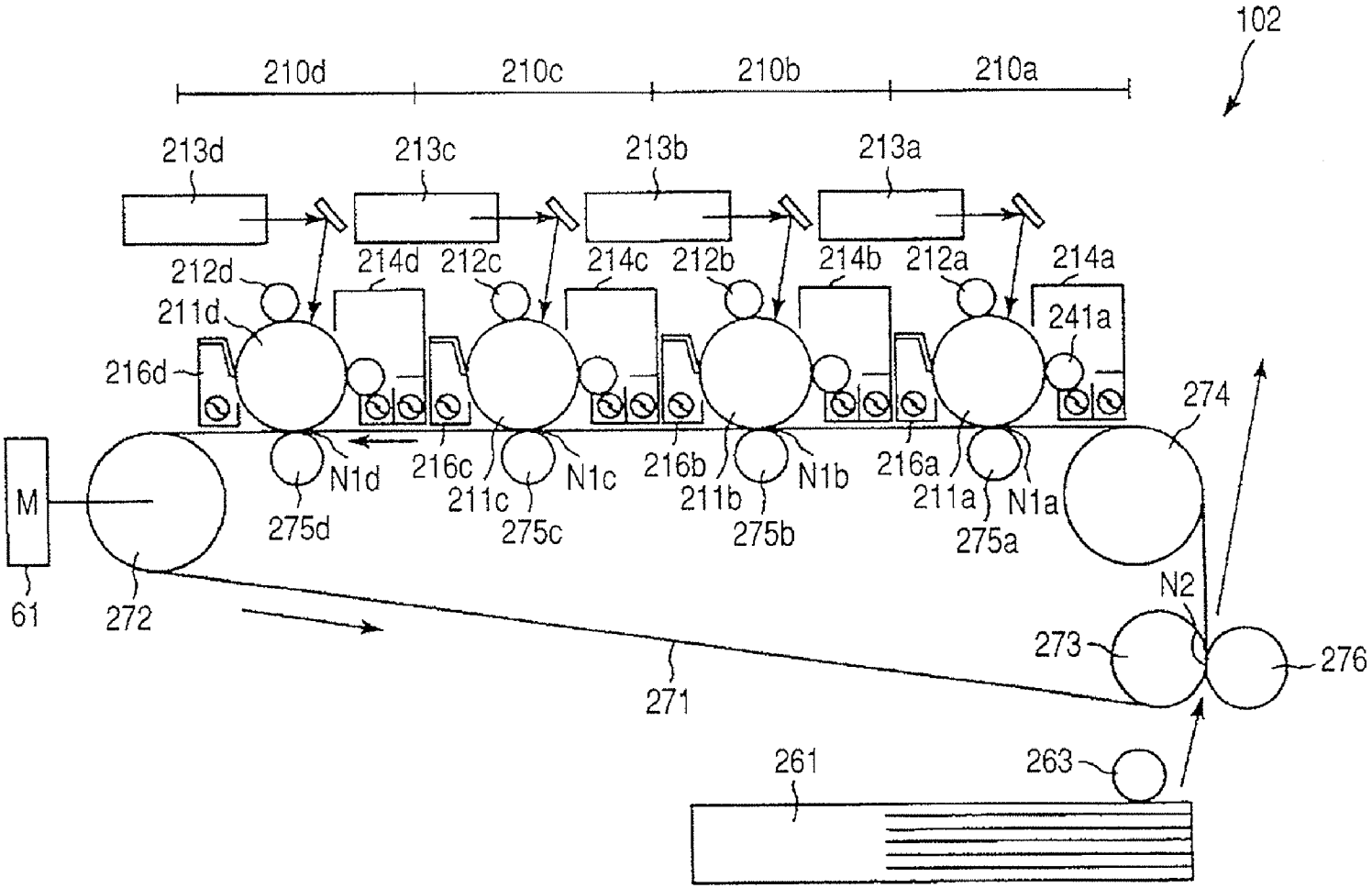
FIG. 19 is a schematic sectional configuration diagram of an image forming apparatus related to an Embodiment 4.

FIG. 19 illustrates a schematic sectional configuration diagram of an image forming apparatus 102 of the present embodiment. The image forming apparatus 102 of the present embodiment is an image forming apparatus of a tandem type having adopted a middle transfer system.

Here, in the image forming apparatus 102 of the present embodiment illustrated in FIG. 19, like reference characters designate the same as and otherwise equivalent to those elements of the image forming apparatus 101 illustrated in FIG. 1 in function as well as configuration to omit detailed description. In addition, FIG. 19 illustrates only key parts inclusively selected from the group consisting of the peripherals of the photosensitive drum 211 of the image forming apparatus 102 of the present embodiment, the middle transferring belt 271, the conveyance unit of the recording material P and the like. A reader unit (manuscript reading unit) 300 provided in the image forming apparatus 100 in FIG. 1, the fixing device 217 and the like are omitted from illustration. However those portions are likewise the Embodiment 1. In addition, in the case where no differentiation is required in particular, elements commonly provided in the respective image forming units 210*a* to 210*d* will be described in a collective manner by omitting the appending characters a, b, c and d which are given to the symbols in order to specify for which colors they are provided.

The image forming apparatus 102 of the present invention is provided with a movable endless belt member as a middle transferring member (recording material conveyance member), that is, a middle transferring belt 271 in opposition to the photosensitive drums 211*a* to 211*d* as the first image bearing member of the respective image forming units 210*a* to 210*d*. The middle transferring belt 271 includes a drive roller 272 as a supporting member and the first and the second driven rollers 273 and 274.

The inner circumference side of the middle transferring belt 271 is provided with primary transferring rollers (primary transferring chargers) 275*a* to 275*d* as primary transferring members in the positions opposing to the photosensitive drums 211*a* to 211*d* of the respective image forming units 210*a* to 210*d*. The primary transferring rollers 275*a* to 275*d* contact the inner circumference side of the middle transferring belt 271 respectively to press the middle transferring belt 271 toward the photosensitive drums 211*a* to 211*d*. Thereby, the primary transferring unit (nip portions) N1*a* to N1*d* where the middle transferring belt 271 and the respective photosensitive drums 211*a* to 211*d* are formed.

The primary transferring voltage having been output from the primary transferring bias output unit (not illustrated in the drawing) is applied to the primary transferring rollers 275. Thereby, the primary transferring roller 275 discharges the middle transferring belt 271 from the rear surface to transfer a toner image on the photosensitive drum 211 onto the middle transferring belt 271.

In addition, in the outer circumference side of the middle transferring belt 271, a secondary transferring roller (secondary transferring charger) 276 as a secondary transferring member is arranged. The secondary transferring roller 276 contacts the middle transferring belt 271 to form the secondary transferring unit (secondary transferring nip) N2. In the secondary transferring belt N2, the middle transferring belt 271 is sandwiched by the driven roller (a roller inside the middle transferring belt) 273 and the secondary transferring roller 276 opposing each other. In the nip portion provided by a pair of rollers of the secondary transferring unit N2, in the present embodiment, secondary transferring voltage output from the secondary transferring bias output unit is applied to the secondary transferring roller 276. Thereby, a toner image on the middle transferring belt 271 is transferred onto a recording material P having been conveyed to reach the secondary transferring unit N2.

The middle transferring unit as a transferring member is adapted to include parts selected from the group consisting of a middle transferring belt 271, the primary transferring belt 271, the primary transferring rollers 275*a* to 275*d*, the transferring roller 276 and the like.

That is, in the image forming apparatus 102 of the present embodiment, toner images formed on the respective photosensitive drums 211*a* to 211*d* of the respective image forming units 210*a* to 210*d* are temporarily transferred (primary transfer) onto the middle transferring belt 271 being the first transferring medium. Thereafter a toner image on the middle transferring belt 271 is transferred (secondary transfer) from the middle transferring belt 271 to the recording material P such as a recording sheet being the second transferring medium. For example, at the time of forming a full color image, four-color toner image is sequentially superimposed in the respective primary transferring units N1*a* to N1*d* to undergo primary transfer onto the middle transferring belt 271. Thereafter, the multiple toner images including that four-color toner collectively undergo secondary transfer onto the recording material P.

Here, in the present embodiment, the exposing unit (electrostatic image forming unit) 213 of the respective image forming units 210 is a laser scanning optical system. The light from that laser scanning optical system 213 forms an electrostatic image on the surface of each photosensitive drum 211. In addition, in the present embodiment, each image forming units 210 is provided with a cleaner 216 for collecting toner (primary transfer residual toner) which has not been completely transferred in the primary transfer process but is left on the photosensitive drum 211.

In the present embodiment, at the time of image forming operation, the photosensitive drums 211*a* to 211*d* of the respective image forming units 210*a* to 210*d* are not provided with an intended speed fluctuation but rotate substantially at a constant speed. In addition, the secondary transferring roller 276 is not provided with the intended speed fluctuation either but rotates substantially at a constant speed.

Here, in the present embodiment, the drive roller 272 for driving the middle transferring belt 271 is driven by the traveling wave motor 61 adapted likewise the Embodiment 1 as the drive unit. In the present embodiment, the traveling wave motor 61 is directly connected to the drive roller 272 without a reduction mechanism.

And, in the present embodiment, that drive roller 272 is driven to provide the traveling wave motor 61 for driving the middle transferring belt 271 with a speed fluctuation with the drive method likewise the Embodiment 1. That can provide the middle transferring belt 271 with a speed fluctuation. That is, it is possible to provide the movement speed of the surface of the middle transferring belt 271 at the time of the base speed drive of the middle transferring belt 271, that is, the base speed with a speed fluctuation.

Here, the base speed of the surface of the middle transferring belt 271 is normally represented by the average movement speed (average speed) of middle transferring belt 271. That average speed typically corresponds to the speed of the center of the fluctuation width of the speed. In addition, normally the base speed of the p middle transferring belt 271 corresponds to the image forming speed.

Consequently, while the respective photosensitive drums 211*a* to 211*d* and the secondary transfer roller 276 are rotating at a constant speed, the middle transferring belt 271 repeats slight sliding to go forward. In addition, in the present embodiment, likewise description in the Embodiment 1, the both of period and volume (amplitude) of the speed fluctuation of the middle transferring belt 271 and otherwise one of period and volume (amplitude) of the speed fluctuation of the middle transferring belt 271 can be controlled corresponding with conditions selected from the group consisting of environment, toner type, types of the recording material and the like. In addition, as the base speed (image output speed) of the middle transferring belt 271 is being changed, the frequency of a speed fluctuation can controlled so as to avoid resonant frequency of each element inside the image forming apparatus 102.

Accordingly, in the present embodiment, the respective primary transferring units N1*a* to N1*d* and the secondary transferring unit N2, an effect likewise the Embodiment 1 is obtainable.

Thus, in the present embodiment, a conversion unit converting alternating voltage of voltage into traveling waves occurring on the surface of the elastic member is used as the drive unit driving the middle transferring member in the direction of image forming, which is the drive unit generating a propelling power with those traveling waves. That drive unit is the traveling wave motor 61, likewise the one in Embodiment 1, being a motor transmitting rotary motion. In the present embodiment, the traveling wave motor 61 is connected directly to the substantially cylindrical drive roller 272 for conveying the middle transferring belt 271 without being mediated by a reduction mechanism. And the traveling wave motor 61 and the drive roller 272 are substantially the same in the rotary angular speed. In addition, in the present embodiment, likewise the Embodiment 1, the image forming apparatus 102 comprises the alternating voltage control unit 80 (FIG. 6) for providing the speed of the drive unit with a fluctuation by controlling the alternating voltage applied to the drive unit to control the period as well as volume (amplitude) of that speed fluctuation.

Here, an appropriate range of the surface movement amount of the middle transferring belt 271 for a period of a speed fluctuation (speed fluctuation period) of the surface of the middle transferring belt 271 and a volume (amplitude) of the speed fluctuation of the surface of the middle transferring belt 271 is likewise those described on the photosensitive drum 211 in Embodiment 1. That is, in the transferring unit of toner, description on the speed fluctuation of the surface of the photosensitive drum 211 in Embodiment 1 is likewise applicable to speed fluctuation of one of the surface bearing pre-transfer toner and the surface where the toner is transferred.

In addition, the base speed on the surface bearing the toner image of at least one photosensitive drum 211 while toner image transfer is going on at least can be substantially the same as and the base speed on the surface where the toner image of the middle transferring belt 271 is transferred. Thereby, the distortion in the transfer image in the primary transferring unit N1 can be restrained. In addition, the base speed of the surface bearing the toner image of the middle transferring belt 271 while toner image transfer is going on at least can be substantially the same as and the movement speed of the surface where the toner image of the recording material P is transferred. Thereby, the distortion in the transfer image in the secondary transferring unit N2 can be restrained.

Moreover, the base speed of a plurality of the surface of the middle transferring belt 271 while toner image transfer is going on at least can be set to the speed substantially the same as the circumferential speed of a plurality of photosensitive drums 211 (four units for the present embodiment). Thereby, distortion in the transfer image in a plurality of primary transferring unit N1 is caused not to occur due to difference in speed and, in addition, no difference is caused to occur in behavior of the middle transferring belt 271 in a plurality of primary transferring units (four portions for the present embodiment), enabling accuracy in superimposing a plurality of colors to get improved. Moreover, the base speed of the surface of the middle transferring belt 271 can be set so as to be equal to the circumferential velocity of the secondary transferring roller 276 in addition to a plurality of photosensitive drums 211. Thereby, distortion in the transfer image in the primary transferring unit N1 is restrained as described above to improve accuracy in superimposing a plurality of colors and, moreover, distortion in the transfer image in the secondary transferring unit N2 can be restrained.

As described above, the present embodiment can improve the transfer performance (transfer efficiency) in the primary transferring unit N1 and the secondary transferring unit N2. According to the present embodiment, likewise the Embodiment 1, the superimposed alternating voltage F2 is superimposed to the base alternating voltage F1. Thereby the speed fluctuation of the middle transferring belt 71 can be controlled easily with respect to frequency as well as volume (amplitude). Otherwise, the control on the speed fluctuation based on various causes described in Embodiment 1 can give rise to following effect likewise description in Embodiment 1. For example, the adaptive range is wide to the fluctuation factor of adhesion of toner selected from the group consisting of environment, toner type, types of the recording material and the like so as to enable improvement in the transfer performance. In addition, the frequency of a speed fluctuation can be set in avoidance of resonant frequency of each element inside the image forming apparatus.

Embodiment 5

Next, a fifth embodiment related to the present invention will be described.

Figure 20:
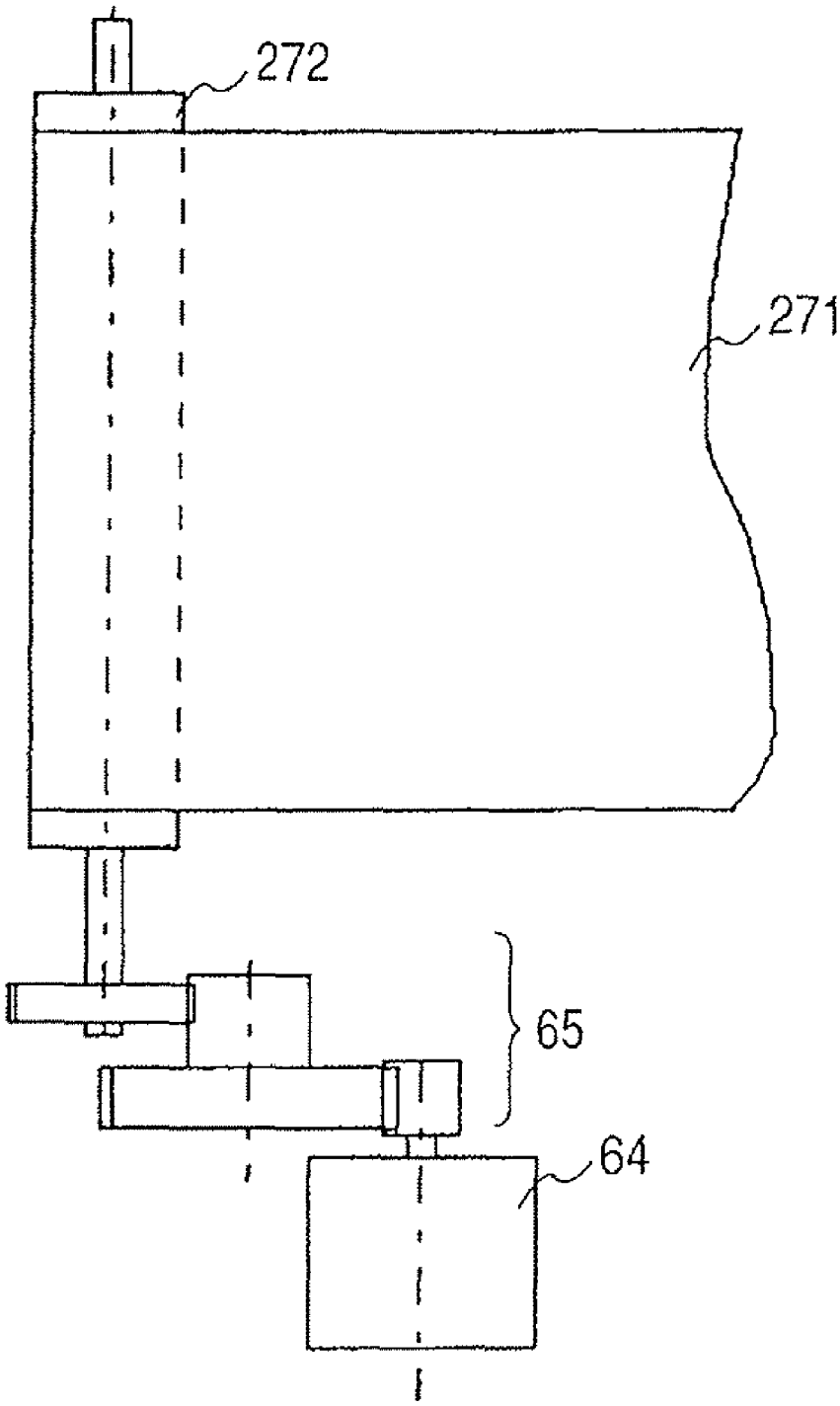
FIG. 20 is a diagram describing a configuration between a stepping motor related to an Embodiment 5 and a train of reduction gears as well as a middle transferring belt.

The drive of the stepping motor 64 is transmitted to the driver roller 272 for driving the middle transferring belt 271 mediated by a reduction-gear train 65. The schematic state thereof is illustrated in FIG. 20. The stepping motor 2061 is adapted likewise the Embodiment 3 to provide the base drive frequency with a speed fluctuation subjected to frequency modulation. Thereby the speed of the middle transferring belt 271 fluctuates as well. Consequently, while the respective photosensitive drum 211 and the secondary transfer bias roller 271 is rotating at a constant speed, the middle transferring belt 271 repeats slight sliding to go forward. Thereby, in the primary transfer and the secondary transfer, an effect likewise the first embodiment can be obtained.

In addition, the average circumferential velocity of the middle transferring belt 271 can be set to get equal to the circumferential velocity of the photosensitive drum 211 and the secondary transferring bias roller 276. Thereby, distortion in the transfer image in the primary transferring unit and otherwise the secondary transferring unit is caused not to occur and, in addition, no difference is caused to occur in behavior of the middle transferring belt 271 in the primary transferring units in four sites, enabling improvement in accuracy in superimposing four colors.

As described above, the present embodiment can improve transfer efficiency in the primary transfer and the secondary transfer by a large margin. Moreover, likewise the Embodiment 3, the base speed drive signal of the motor undergoes frequency modulation and thereby the speed fluctuation in the photosensitive drum 211 can be controlled.

Embodiment 6

An embodiment 6 of the present invention will be described. The present embodiment is different from the Embodiment 3 and the Embodiment 5 in the portion on the frequency modulation drive of the stepping motor. The subject to be driven can be a photosensitive drum 211 being an image bearing member and otherwise middle transferring belt 271 being a primary transferring medium.

Figure 21A:
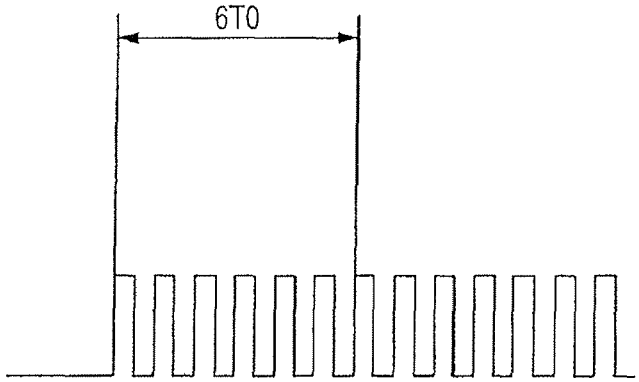
FIGS. 21A and 21B are diagrams describing a pseudo frequency modulation signal method in an Embodiment 6.
Figure 21B:
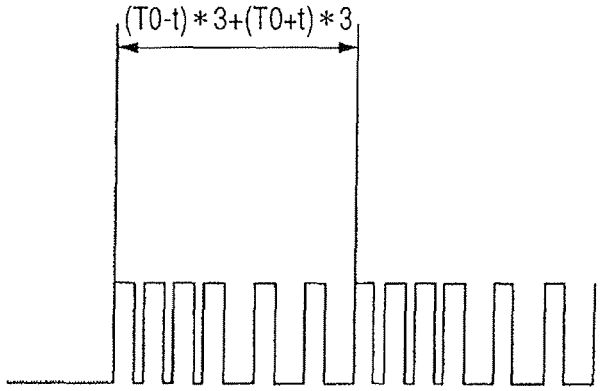

The mode of the Embodiment 3 and the Embodiment 5 generated a speed fluctuation in the photosensitive drum and otherwise in the middle transferring belt as a result of having modulated the drive signal of the stepping motor in frequency. The present invention is marked by giving rise to a speed fluctuation of the photosensitive drum with frequency modulation using the stepping motor as pseudo modulation. FIGS. 21A and 21B illustrate pseudo frequency modulation signal of the stepping motor of the present embodiment. The state providing pseudo frequency modulation in the style different from the state of frequency modulation illustrated in FIGS. 17A, 17B and 17C will be described with reference to FIGS. 21A and 21B. As a method of adding pseudo frequency modulation in the case of, for example, base frequency TO, FIGS. 21A and 21B illustrate the state where predetermined time t is subtracted from the first half of three pulses for the pulse row equivalent to six periods and predetermined time t is added to the latter half of three pulses. There is no change in the original time 6TO for six periods does not change but the first half three periods are shorter in the amount t for the base frequency TO and the latter half three periods are longer in the amount t for the base frequency TO. Also in the case where frequency modulation circuit is present on a drive circuit (the case with a pulse transmission controller so-called sequencer, and the like), the setting hereof can apply pseudo frequency modulation to the original control signal by appropriately selecting the N periods and time t hereof to extend application range as an apparatus.

As described above, pseudo frequency modulation generates a speed fluctuation in the traveling wave motor to vary the circumferential velocity of the photosensitive drum and otherwise the middle transferring belt thereby to enable improvement in transfer performance.

As described above, the image forming apparatus of the present embodiment is simpler than Embodiments 3 and 5 in adaptation and nevertheless can improve the transfer performance. In addition, the pseudo frequency modulation control unit can freely change the pseudo modulation frequency and therefore can realize the effects likewise the Embodiments 3 and 5.

Other Embodiments

Next, other embodiments related to the present invention will be described.

In the Embodiment 1, the photosensitive drum 211 in the image forming apparatus 101 illustrated in FIG. 1 was a subject for a speed fluctuation. In addition, in the Embodiment 4, the middle transferring belt 271 in the image forming apparatus 102 illustrated in FIG. 19 was a subject for a speed fluctuation.

The present invention will not limit the subject for a speed fluctuation to photosensitive drum 211 and the middle transferring belt 271 in the above described respective embodiments but modes described below are realizable. Here, in the following description, like reference characters designate the same as and otherwise equivalent to those elements of the above described respective embodiments in function as well as configuration to omit detailed description.

At first, in the image forming apparatus 101 illustrated in FIG. 1, the conveyance belt 251 can be taken as the subject for a speed fluctuation. In that case, typically, the photosensitive drums 210*a* to 210*d* of the respective image forming units 211*a* to 211*d* are not provided with the intended speed fluctuation at the time of image forming operation but can rotate substantially at a constant speed. And a driver roller 252 for driving the conveyance belt 251 is driven with a traveling wave motor 61 adapted likewise the above described respective embodiments as a drive unit. Desirably, that traveling wave motor 61 is directly connected to the drive roller 252 without being mediated by a reduction mechanism. The desirable range of the period and the volume (amplitude) of the speed fluctuation described in the above described respective embodiments and otherwise the other features on the speed fluctuation control are likewise applicable to the case where the subject for a speed fluctuation is the conveyance belt 251. Thereby, in the transfer units Na to Nd, an effect likewise the above described respective embodiments can be obtained.

In addition, in the image forming apparatus 102 illustrated in FIG. 19, the secondary transferring roller 276 can be a subject for a speed fluctuation. In that case, typically, middle transferring belt 271 is not provided with the intended speed fluctuation but can rotate substantially at a constant speed at the time of image forming operation. And the secondary transferring roller 276 is driven with a traveling wave motor 61 adapted likewise the above described respective embodiments as a drive unit. Desirably, that traveling wave motor 61 is directly connected to the secondary transferring roller 276 without being mediated by a reduction mechanism. The desirable range of the period and the volume (amplitude) of the speed fluctuation described in the above described respective embodiments and otherwise the other features on the speed fluctuation control are likewise applicable to the case where the subject for a speed fluctuation is the secondary transferring roller 276. Thereby, in the secondary transfer unit N2, an effect likewise the above described respective embodiments can be obtained.

Figure 22:
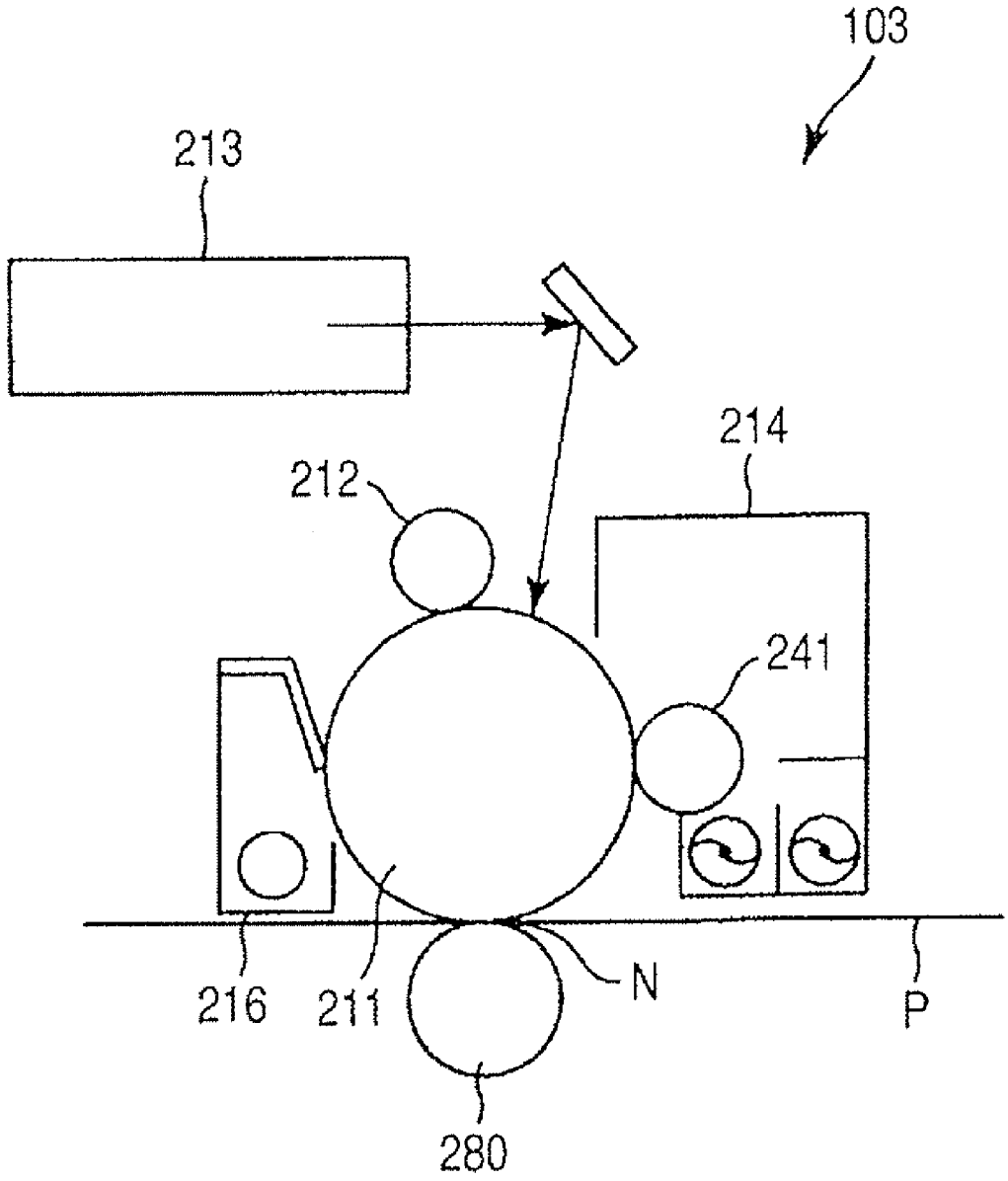
FIG. 22 is a schematic sectional configuration diagram of an image forming apparatus related to another embodiment.

Moreover, as illustrated in FIG. 22, an image forming apparatus 103 including a single image forming unit and including a transfer roller 280 as a transfer member coming into connection to the photosensitive drum 211 as an image bearing member mediated by the recording material P. The transfer roller 280, to which transfer voltage output from the transfer bias output unit is applied, transfers toner onto a recording material P on the photosensitive drum 211 in a transfer unit (transfer nip) N formed by the photosensitive drum 211 and the transfer roller 280 opposing each other mediated by the recording material P. In such an image forming apparatus 103, the transfer roller 280 can be a subject for a speed fluctuation. In that case, typically, the photosensitive drum 211 is not provided with the intended speed fluctuation but can rotate substantially at a constant speed at the time of image forming operation. And a transfer roller 280 is driven with a traveling wave motor 61 adapted likewise the above described respective embodiments as a drive unit. Desirably, that traveling wave motor 61 is directly connected to the transfer roller 280 without being mediated by a reduction mechanism. The desirable range of the period and the volume (amplitude) of the speed fluctuation described in the above described respective embodiments and otherwise the other features on the speed fluctuation control are likewise applicable to the case where the subject for a speed fluctuation is the transfer roller 280. Thereby, in the transfer unit N, an effect likewise the above described respective embodiments can be obtained. Here, in the image forming apparatus 103 illustrated in FIG. 22, the photosensitive drum 211 can of course be a subject for a speed fluctuation likewise the Embodiment 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2006-183948, filed Jul. 3, 2006, and 2007-170666, filed Jun. 28, 2007, which are hereby incorporated by reference herein in their entirety.

What is claimed is:

1. An image forming apparatus comprising:

a movable image bearing member that bears a toner image;

a moving member that forms a nip portion with said movable image bearing member; and a motor that moves said image bearing member or said moving member, wherein a toner image is transferred at the nip portion from the image bearing member; and wherein an alternating voltage whose amplitude is modulated by superposing a superposed alternating voltage into a base voltage capable of rotating the motor at a constant speed is applied into the motor, so that the rotational speed of the motor periodically varies.

2. An image forming apparatus according to claim 1, wherein said image bearing member is a rotary member and the motor moves the image bearing member and a rotation axis of the image bearing member and a rotation axis of the motor are connected.

3. An image forming apparatus according to claim 1, wherein the moving member is a rotary member and the motor moves the image bearing member and a rotation axis of the image bearing member and a rotation axis of the motor are connected.

4. An image forming apparatus according to claim 1, wherein the motor is a traveling wave motor and the base voltage and the oscillatory voltage are alternating voltage respectively different in frequency.

5. An image forming apparatus according to claim 4, wherein the traveling wave motor is an ultrasonic motor.

6. An image forming apparatus according to claim 1 further comprising:

a driver;

wherein the driver composes the base voltage and the oscillatory voltage inside the driver and to thereafter input to the motor.

7. An image forming apparatus according to claim 1, wherein the moving member receives transfer of a toner image from the image bearing member to transfer a toner image from the moving member to recording material.

8. An image forming apparatus according to claim 1, wherein the moving member bears a recording material and transfers a toner image on the image bearing member to the recording material born by the moving member.

9. An image forming apparatus according to claim 1, wherein the moving member conveys a recording material and a toner image on the image bearing member is transferred to the recording material in the nip portion.

10. An image forming apparatus according to claim 1, further comprising a shaft, wherein said image bearing member is a rotary member and the motor moves the image bearing member and the shaft is a rotation axis of the image bearing member and a rotation axis of the motor.

11. An image forming apparatus according to claim 1, further comprising a shaft, wherein the moving member is a rotary member and the motor moves the image bearing member and the shaft is a rotation axis of the image bearing member and a rotation axis of the motor.

12. An image forming apparatus comprising:

a movable image bearing member that bears a toner image;

a movable moving member that forms a nip portion with the image bearing member;

a motor that moves the image bearing member or the moving member; and a driver inputting drive voltage to the motor, wherein a toner image is transferred in the nip portion from the image bearing member; and wherein the driver modulates frequency of base voltage capable of rotating the motor at a constant speed so that the rotational speed of the motor periodically varies.

13. An image forming apparatus according to claim 12, wherein the image bearing member is a rotary member and the motor moves the image bearing member and a rotation axis of the image bearing member and a rotation axis of the motor are connected.

14. An image forming apparatus according to claim 12, wherein the moving member is a rotary member and the motor moves the image bearing member and a rotation axis of the image bearing member and a rotation axis of the motor are connected.

15. An image forming apparatus according to claim 12, wherein the motor is a stepping motor.

16. An image forming apparatus according to claim 12, wherein the motor is a traveling wave motor.

17. The image forming apparatus according to claim 16, wherein the traveling wave motor is an ultrasonic motor.

18. An image forming apparatus according to claim 12, wherein the moving member receives transfer of a toner image from the image bearing member to transfer a toner image from the moving member to recording material.

19. An image forming apparatus according to claim 12, wherein the moving member bears recording material and transfers a toner image on the image bearing member to the recording material born by the moving member.

20. An image forming apparatus according to claim 12, wherein the moving member conveys a recording material and a toner image on the image bearing member is transferred to the recording material in the nip portion.

21. An image forming apparatus according to claim 12, further comprising a shaft, wherein said image bearing member is a rotary member and the motor moves the image bearing member and the shaft is a rotation axis of the image bearing member and a rotation axis of the motor.

22. An image forming apparatus according to claim 12, further comprising a shaft, wherein the moving member is a rotary member and the motor moves the image bearing member and the shaft is a rotation axis of the image bearing member and a rotation axis of the motor.

23. An image forming apparatus comprising:

a movable image bearing member that bears a toner image;

a movable moving member that forms a nip portion with the image bearing member;

a motor that moves the image bearing member or the moving member;

a driver that inputs a drive voltage to said motor, wherein said driver controls the drive voltage to be input to said motor to periodically vary a rotational speed of said motor and;

an environment sensor that detects circumstances of said image forming apparatus, wherein said driver applies the drive voltage to periodically vary a rotational speed of said motor into said driver based on a detection result by said environment sensor, and wherein a toner image is transferred in the nip portion from the image bearing member.

* * * * *